US007780342B2

(12) United States Patent
Takahashi et al.

(10) Patent No.: US 7,780,342 B2
(45) Date of Patent: Aug. 24, 2010

(54) SPRING DEVICE AND TIMEPIECE

(75) Inventors: Osamu Takahashi, Nagano (JP); Nobuyuki Hirose, Nagano (JP); Masaaki Maejima, Nagano (JP); Masatoshi Moteki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 12/207,164

(22) Filed: Sep. 9, 2008

(65) Prior Publication Data

US 2009/0086584 A1 Apr. 2, 2009

(30) Foreign Application Priority Data

Sep. 28, 2007 (JP) ..... 2007-254148

(51) Int. Cl.
*G04B 1/10* (2006.01)

(52) U.S. Cl. ..... 368/140; 368/147; 368/210

(58) Field of Classification Search ..... 368/140, 368/147, 210
See application file for complete search history.

(56) References Cited

U.S. PATENT DOCUMENTS 223,418 A 1/1880 Ware
6,584,043 B1 * 6/2003 Koike et al. ..... 368/204
6,877,893 B2 * 4/2005 Mock et al. ..... 368/127
6,973,010 B1 * 12/2005 Koike et al. ..... 368/204

FOREIGN PATENT DOCUMENTS

EP 0 950 931 A2 10/1999
JP 2000-147153 A 5/2000
JP 3582383 B 8/2004

* cited by examiner

*Primary Examiner*—Vit W Miska
*Assistant Examiner*—Jason Collins
(74) *Attorney, Agent, or Firm*—Global IP Counselors, LLP

(57) ABSTRACT

A spring device having an inside-end wheel that moves in conjunction with the inside end of a mainspring; an outside-end wheel that moves in conjunction with the outside end of the mainspring; a torque return unit that transfers part of the output torque of the mainspring from one to the other of the inside-end wheel and outside-end wheel; a duration time indicating unit that operates in conjunction with both the inside-end wheel and outside-end wheel and indicates the number of winds in the mainspring; and a torque transfer clutch unit that disengages torque transfer between the inside-end wheel and outside-end wheel by means of the torque return unit when the mainspring unwinds and the duration time indicating unit indicates a predetermined reference number of winds.

8 Claims, 24 Drawing Sheets

SPRING DEVICE AND TIMEPIECE

BACKGROUND

1. Field of Invention

The present invention relates to a spring device and to a timepiece having this drive device.

2. Description of Related Art

Mechanical timepieces and electronically controlled mechanical timepieces use a mainspring as the drive power source. Assuming the same number of winds, the mechanical energy/volume ratio of a mainspring increases as the maximum output torque increases. The duration time of the mainspring can therefore be increased by either using a spring with greater torque or reducing the torque required to drive the wheel train, but these methods create the need for design changes such as increasing the speed-increasing ratio from the barrel to the second wheel or making the wheel diameters and wheel modules smaller. Both such designs and manufacturing such products are difficult.

As described in Japanese Patent 3582383, we developed a mainspring torque output device that connects the barrel wheel and ratchet wheel using a wheel train with an odd number of wheels. Part of the output torque of the mainspring is returned to the mainspring by speed reducing rotation of the ratchet wheel transferred to the barrel by means of the wheel train, and the spring is wound by the returned torque. The configuration taught in Japanese Patent 3582383 can thus increase the duration time of the mainspring without designing and manufacturing special modules or wheel diameters that are different from usual.

With the configuration taught in Japanese Patent 3582383, however, output power from the mainspring is consumed by winding the spring when the mainspring unwinds and output drops because the barrel wheel and ratchet wheel are connected by a wheel train, and there may not be enough torque to drive the timepiece. This can be resolved by increasing the maximum output torque of the spring, but increasing the volume of the barrel to increase the maximum output of the spring is difficult in small devices such as a timepiece. As a result, further increasing the duration time of the mainspring is difficult with the configuration taught in Japanese Patent 3582383.

SUMMARY

The spring device and timepiece according to the present invention enable further increasing the duration time of the mainspring without interfering with reducing size.

A spring device according to a first aspect of the invention has an inside-end wheel that moves in conjunction with the inside end of a mainspring; an outside-end wheel that moves in conjunction with the outside end of the mainspring; a torque return unit that transfers part of the output torque of the mainspring from one to the other of the inside-end wheel and outside-end wheel; a duration time indicating unit that operates in conjunction with both the inside-end wheel and outside-end wheel and indicates the number of winds in the mainspring; and a torque transfer clutch unit that disengages torque transfer between the inside-end wheel and outside-end wheel by means of the torque return unit when the mainspring unwinds and the duration time indicating unit indicates a predetermined reference number of winds.

The invention thus connects the inside-end wheel and the outside-end wheel through the torque return unit only when the mainspring is wound greater than a reference number of winds so that the mainspring is wound by part of the output torque of the mainspring communicated through the drive wheel train being returned through the torque return unit to the mainspring. When the mainspring unwinds to a number of winds less than the reference number of winds, the connection between the inside-end wheel and outside-end wheel is disengaged by the torque transfer clutch unit, and all output torque from the mainspring is applied to driving the drive wheel train.

This reference number of winds is set desirably according to the torque characteristic of the spring, the torque required to drive the driven object, and the speed-reducing ratio between the inside-end wheel and outside-end wheel of the torque return unit, for example.

The torque output from the mainspring to the drive wheel train, for example, can be adjusted by appropriately setting the speed-reducing ratio between the inside-end wheel and outside-end wheel.

When the number of winds in the mainspring is greater than the reference number of winds, that is, when the output torque exceeds the torque required to drive the driven object, the invention uses output torque from the mainspring to wind the mainspring. When the number of winds is less than this reference number of winds, torque transfer by the torque return unit is interrupted to conserve the torque consumed by winding the mainspring. As a result, the time from when the mainspring starts unwinding until the driven object stops, that is, the duration time of the mainspring, can be increased.

In addition, because the duration time of the mainspring is increased by the amount that the mainspring is wound when the number of winds exceeds the reference number of winds, and excess torque is thus consumed winding the mainspring, communication of excess torque to the drive wheel train can be suppressed. The durability of the drive wheel train can therefore be improved.

In another aspect of the invention the torque return unit preferably restricts torque transfer in the opposite direction as the torque transfer direction between the inside-end wheel and outside-end wheel.

When the mainspring is wound by rotation of a crown, rotor, or other winding member in this aspect of the invention, torque from rotation of the winding member is not communicated through the torque return unit to the drive wheel train, and normal operation of the drive wheel train and duration time indicating unit is therefore not disrupted.

In a spring device according to another aspect of the invention the torque return unit includes a torque receiving wheel that receives torque from the mainspring, a torque return wheel that is disposed coaxially to the torque receiving wheel and returns torque from the mainspring toward the mainspring, a pair of clutch members that are disposed coaxially to the torque receiving wheel and the torque return wheel respectively and engage by relative movement therebetween in the axial direction, a clutch operating cam that is disposed coaxially to one of the clutch members and has a spiral step that rises toward the other clutch member, and an urging member that urges the one clutch member to the other clutch member and causes the clutch members to engage. The torque transfer clutch unit includes a clutch lever that engages the clutch operating cam. The clutch lever engages the clutch operating cam when the mainspring unwinds and the duration time indicating unit indicates the reference number of winds, and engagement of the pair of clutch members is disengaged when the torque receiving wheel rotates after the clutch lever engages the clutch operating cam.

When the duration time indicating unit indicates the reference number of winds, engagement of the clutch is disengaged by rotation of the torque receiving wheel, which turns slowly at substantially the same speed as the rotation of the barrel housing the mainspring, and the connection between the inside-end wheel and outside-end wheel is thus disconnected. The mainspring load required to disengage the inside-end wheel and outside-end wheel is thus reduced by slowly disengaging at substantially the same speed as the rotation of the barrel.

Because the torque receiving wheel, torque return wheel, clutch members, clutch operating cam, and urging member of the torque return unit are small parts that can be arranged and positioned efficiently, the spring device does not become large.

In order to increase the duration time of the mainspring, it is generally necessary to increase the width, thickness, or number of winds in the mainspring, thereby increasing the volume of the mainspring, or to use a plurality of mainsprings, necessarily increasing the size of the assembly or device in which the mainspring is used. The invention, however, can render the torque return unit with good space efficiency, and the duration time of the mainspring can be improved without enlarging the spring device.

In a spring device according to another aspect of the invention a winding unit that operates when the mainspring is wound by a winding member, and an unwinding member that operates when the mainspring unwinds, are disposed to the duration time indicating unit; and the duration time indicating unit includes a first working part that operates a lever rendering the torque transfer clutch unit, a second working part that operates a torque limiter member that locks the winding unit when the mainspring is wound to a maximum number of winds, and a third working part that operates a drive limiting member that locks the unwinding unit when the mainspring unwinds to a minimum number of winds.

In this aspect of the invention control of the three functions associated with the torque transfer clutch unit, torque limiter member, and drive limiting member is handled by the single duration time indicating unit, and the configuration is therefore not complicated.

The second working part and the torque limiter member also prevent a drop in the durability of the mainspring caused by overwinding the mainspring, and the third working part and the drive limiting member prevent incorrect operation when the output torque of the mainspring is low.

In a spring device according to another aspect of the invention a winding unit that operates when the mainspring is wound by a winding member, and torque limiter member that locks the winding unit when the mainspring is wound to a maximum number of winds, are disposed to the duration time indicating unit. The torque return unit includes a connecting shaft composed of a first shaft and a second shaft that are connected coaxially, a first shaft receiving wheel that moves in conjunction with the first shaft and receives torque from the mainspring, a second shaft return wheel that moves in conjunction with the second shaft and returns torque from the mainspring to the mainspring, and the first shaft has a predetermined amount of backlash enabling rotation relative to the second shaft from when the mainspring begins to unwind until locking by the torque limiter member is disengaged.

In this aspect of the invention the connecting shaft has two parts, and the first shaft and second shaft parts are not engaged with each other until the mainspring unwinds from the locked position of the torque limiter member to where the torque limiter member is disengaged. Rotation of the first shaft receiving wheel is therefore not communicated to the second shaft return wheel during this time. The torque return function therefore also does not work, and the torque return function only begins to work once the first shaft and second shaft engage and work in unison.

Even if the torque return function is made to work when the torque limiter member is engaged, the torque return unit cannot wind the mainspring and the mainspring cannot unwind, and the mainspring therefore stops. More specifically, by not allowing the torque return function to work until the wheel train is released by the torque limiter member, the torque limiter function and the torque return function can both be used effectively.

A spring device according to another aspect of the invention also has a duration time display wheel that speed reduces rotation of the duration time indicating unit, and an indicating member attached to the duration time display wheel. The speed-reducing ratio of the duration time indicating unit and the duration time display wheel when torque transfer between the inside-end wheel and outside-end wheel is engaged by the torque transfer clutch unit is smaller than the speed-reducing ratio of the duration time indicating unit and duration time display wheel when torque transfer is disengaged by the torque transfer clutch unit.

This aspect of the invention enables driving the indicating member at a uniform drive speed both before (while engaged) and after (when disengaged) the torque transfer clutch unit is disengaged without the drive speed of the indicating member slowing before the torque transfer clutch unit disengages (while it is engaged). The remaining number of winds in the mainspring (the power reserve) can therefore be easily known from the position indicated by the indicating member.

Yet further preferably, the duration time display wheel and the duration time indicating unit of the spring device each have tooth forms of a first speed-reducing ratio that mesh when the torque transfer clutch unit is engaged, and tooth forms of a second speed-reducing ratio that mesh when the torque transfer clutch unit is disengaged, and an urging member that constrains backlash between the duration time indicating unit and the duration time display wheel is disposed to the duration time display wheel.

By thus rendering the duration time indicating unit and the duration time display wheel with a plurality of different tooth forms, the speed-reducing ratio of the duration time indicating unit and duration time display wheel can be changed by means of a simple configuration, and the backlash that tends to increase with such a configuration can be constrained by the urging member. The indicating member can therefore be prevented from bouncing. The indicating member can therefore be driven to an accurate position even if the indicating member moves back and forth between the different tooth forms as the number of winds in the mainspring increases and decreases.

Another aspect of the invention is a timepiece that has the spring device of the invention and operates using the mainspring as the power source.

By using the spring device of the invention, the timepiece also obtains the benefit of the operation and effects described above. More specifically, the duration time of the mainspring can be increased while retaining a small size.

As described above, excessive torque is not applied to the drive wheel train because part of the output torque of the mainspring is consumed winding the mainspring when the output torque of the mainspring is high. The durability of the wheel train and bearings can therefore be improved. In a mechanical timepiece having an escapement, timekeeping precision is improved by preventing noise from excessive torque. In an electronically controlled mechanical timepiece, the need for electromagnetic braking of the generator can be reduced as a result of excessive torque not being applied, and the size of the generator can therefore be reduced.

The invention enables further increasing the duration time of the mainspring in a configuration in which the mainspring is wound by returning part of the output torque of the mainspring to the mainspring.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
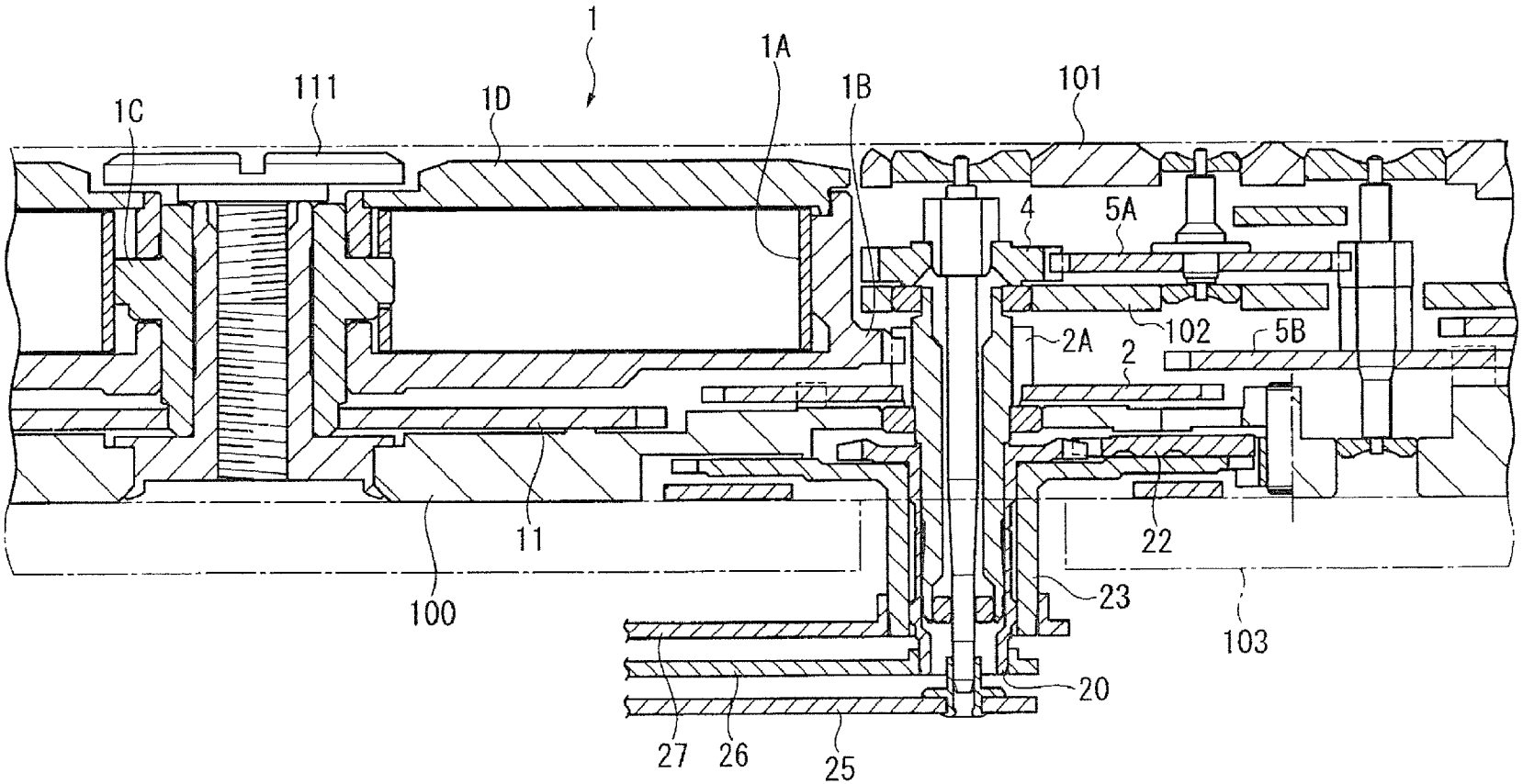
FIG. 1 is a vertical section view showing the first wheel and drive wheel train of a timepiece according to a first embodiment of the invention.

Preferred embodiments of the present invention are described below with reference to the accompanying figures. Note that parts that are functionally the same as parts that have already been described are identified by the same reference numerals, and further description thereof is omitted.

The timepiece according to this embodiment of the invention is an electronically controlled mechanical timepiece that has a duration time display mechanism (power reserve mechanism), torque limiter mechanism, movement stopping mechanism, and torque return mechanism as described below.

1. Basic Configuration of an Electronically Controlled Mechanical Timepiece

The basic configuration of a timepiece according to this embodiment of the invention is described briefly next.

Figure 2:
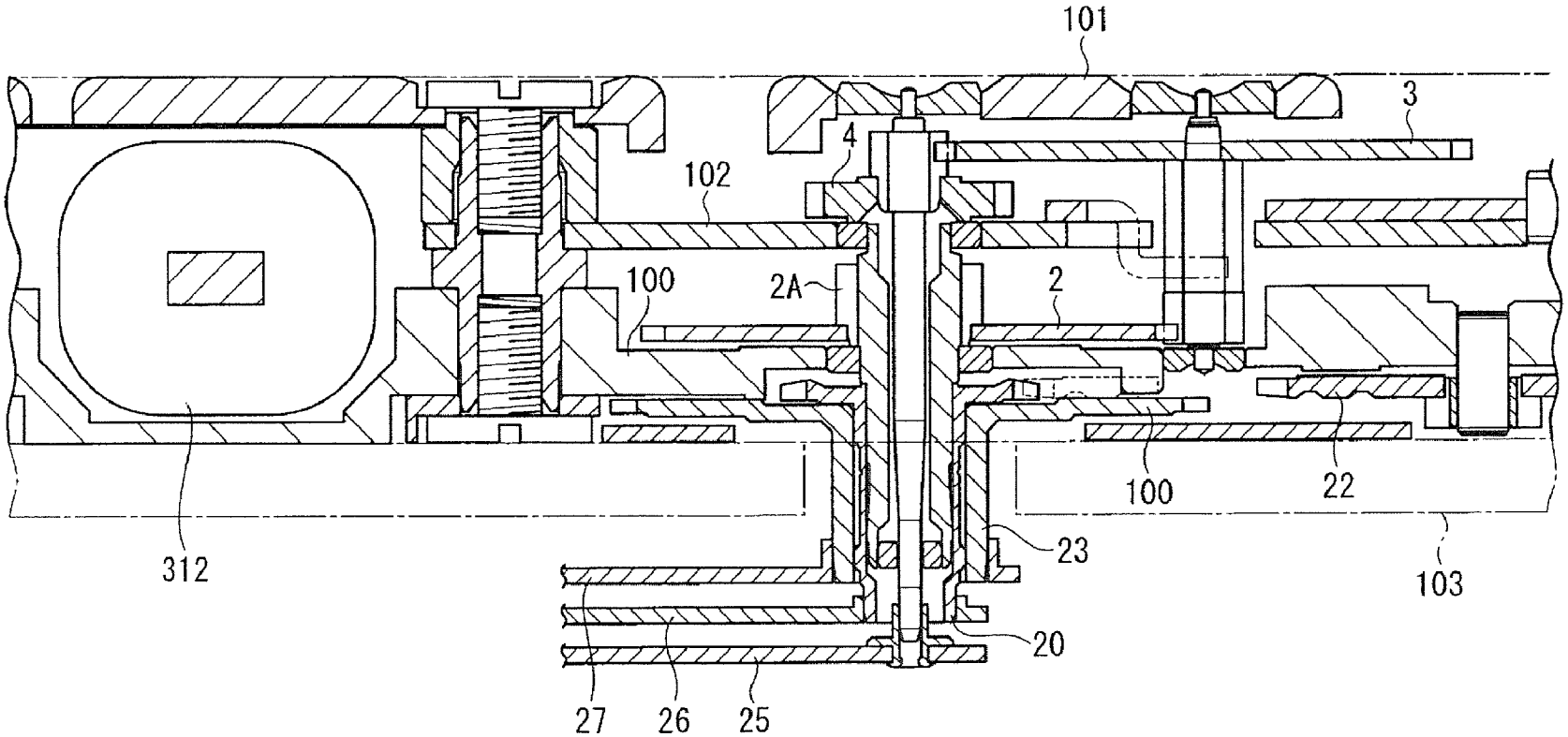
FIG. 2 is a vertical section view showing the first wheel and drive wheel train of the timepiece.
Figure 3:
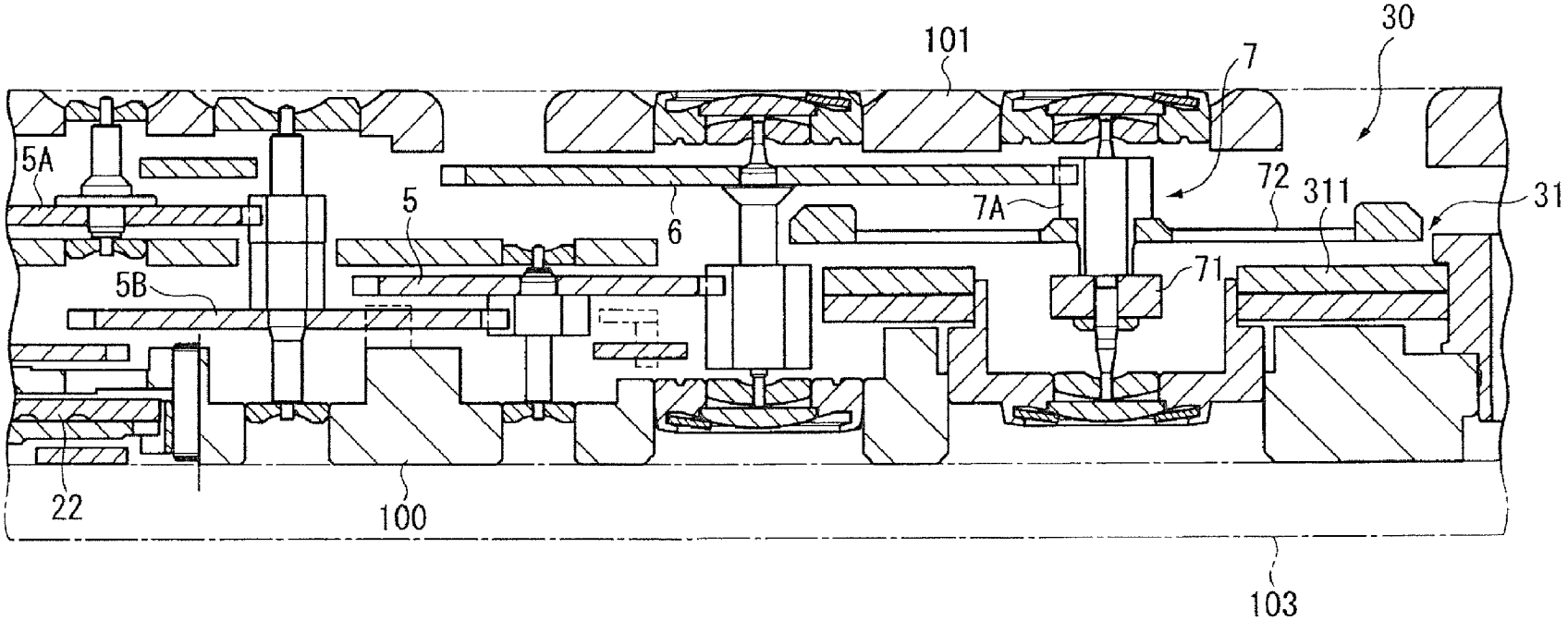
FIG. 3 is a vertical section view showing the drive wheel train and rotor of the timepiece.

FIG. 1 to FIG. 3 are vertical section views of a timepiece according to this embodiment of the invention. The movement of the timepiece in this embodiment of the invention includes a barrel 1 (FIG. 1) that houses a mainspring as the power source of the timepiece, various wheels 2-6 (FIG. 1 to FIG. 3), a generator 30 having a rotor 7 (FIG. 3), and a circuit board not shown that operates using power supplied from the generator 30.

The barrel 1, wheels 3-6, and the rotor 7 are supported on the base plate 100 and wheel train bridge 101. The second wheel 2 is supported by the base plate 100 and a second wheel bridge 102. A dial 103 is also attached to the base plate 100.

As shown in FIG. 1, the barrel 1 has a mainspring 1A, a barrel wheel 1B, a barrel arbor 1C, and a barrel cover 1D.

The outside end of the mainspring 1A is fixed to the barrel wheel 1B as the outside-end wheel, and the inside end of the mainspring 1A is fixed to the barrel arbor 1C. The barrel arbor 1C is fixed to the base plate 100 by a ratchet screw 111, and rotates in unison with the ratchet wheel 11, that is, the inside-end wheel.

Torque from the mainspring 1A housed in the barrel 1 is output through the barrel wheel 1B to the second wheel 2. The speed-increasing ratio of the second wheel pinion 2A to the barrel wheel 1B is 9.8. The barrel 1 thus turns one revolution in 9.8 hours, and the second wheel 2 turns one revolution in 1 hour.

The second wheel 2 (FIG. 1), the third wheel 3 (FIG. 2), the fourth wheel 4 (FIG. 1), the first intermediate fifth wheel 5A (FIG. 1), the second intermediate fifth wheel 5B (FIG. 1), the fifth wheel 5 (FIG. 3), the sixth wheel 6 (FIG. 3), and the rotor 7 (FIG. 3) render a speed-increasing wheel train through which torque output from the barrel wheel 1B is sequentially transmitted, and the rotor 7 turns 8 revolutions in 1 second. The speed-increasing ratio from the second wheel 2 to the rotor 7 is 28,800, and the speed-increasing ratio from the barrel 1 to the rotor 7 is 282,240.

The assembly from the second wheel 2 to the rotor 7 renders a drive wheel train that drives the hands. As shown in FIG. 1, the minute hand 26 is attached to the cannon pinion 20 fixed to the second wheel 2, and the second hand 25 is attached to the fourth wheel 4. Rotation of the cannon pinion 20 is speed reduced to 1/12 and transmitted through the day wheel 22 to the hour wheel 23, to which the hour hand 27 is attached.

As shown in FIG. 3, the generator 30 includes the rotor 7, around the shaft of which is attached a permanent magnet 71, and a coil block 31 including a stator unit 311 and a coil unit 312 (FIG. 2). The rotor 7 has a rotor pinion 7A, the permanent magnet 71, and a round inertial plate 72 that suppresses fluctuation in the speed of the rotor 7.

The electronic circuitry mounted on the circuit board not shown is driven by power supplied from the generator 30. An accurate time standard is produced by the electronic circuit, and rotation of the rotor 7 is controlled based on this time standard.

The electronic circuitry includes a booster rectifying circuit that boosts and rectifies the AC output from the generator 30, a capacitor that is charged by the rectified power, a crystal oscillator and frequency dividing circuit that produce the time standard, a rotation detection circuit that detects rotation of the rotor 7 from the waveform output of the generator, a speed comparison circuit that compares the time standard and rotor 7 rotation, and an electromagnetic brake control circuit that controls the time interval of an electromagnetic brake based on the result of the speed comparison.

The electromagnetic brake control circuit controls the time interval of the electromagnetic brake, which shorts the coil block 31 based on the result output from the speed comparison circuit. The brake power of this electromagnetic brake keeps the period of generator 30 rotation constant. More specifically, the rotational speed of the drive wheel train is constant and the hour hand 27, minute hand 26, and second hand 25 move accurately only in the torque range of the mainspring that causes the rotor 7 to turn at a speed where the electromagnetic brake is required.

As described above, in an electronically controlled mechanical timepiece the drive wheel train and the hands are driven by the mechanical energy of the mainspring while the speed of the wheel train is regulated by electrical energy converted from a portion of the mechanical energy of the mainspring.

2. Mainspring Winding Mechanism

Figure 4:
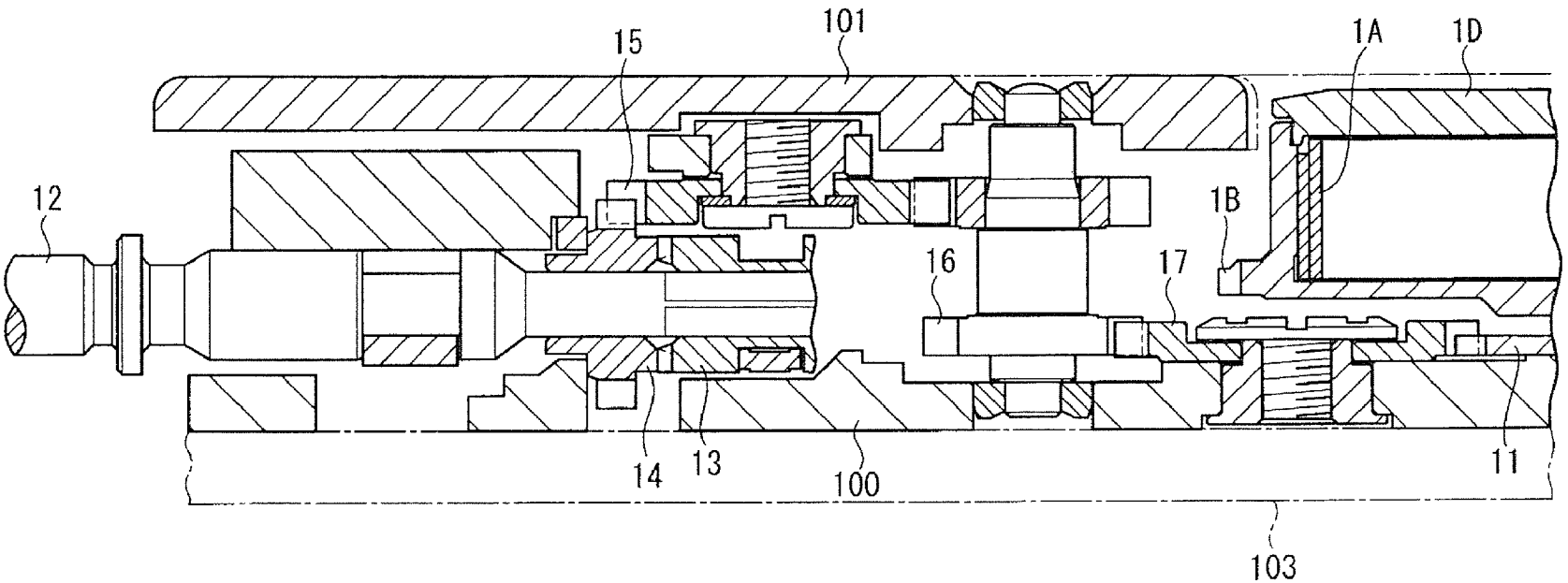
FIG. 4 is a vertical section view showing the timepiece winding unit.

The winding mechanism of the mainspring 1A is described next with reference to FIG. 4.

When the winding stem 12 connected to the crown as a winding member not shown is turned, the ratchet wheel 11 is turned by the intervening clutch wheel 13 guided by the winding stem 12 and a square hole, a winding pinion 14 that meshes with the clutch wheel 13, the crown wheel 15, a first intermediate ratchet wheel 16, and a second intermediate ratchet wheel 17. Rotation of the ratchet wheel 11 turns the barrel arbor 1C (FIG. 1), which winds the mainspring 1A.

A click (not shown in the figure) that causes the ratchet wheel 11 to turn clockwise (when seen from the opposite side as the dial) but does not allow the ratchet wheel 11 to turn counterclockwise is disposed to the ratchet wheel 11. The click functions as a one-way clutch, and the ratchet wheel 11 therefore does not turn when the mainspring 1A unwinds.

3. Duration Time Display Mechanism

The duration time display mechanism (power reserve mechanism) is described next.

Figure 5:
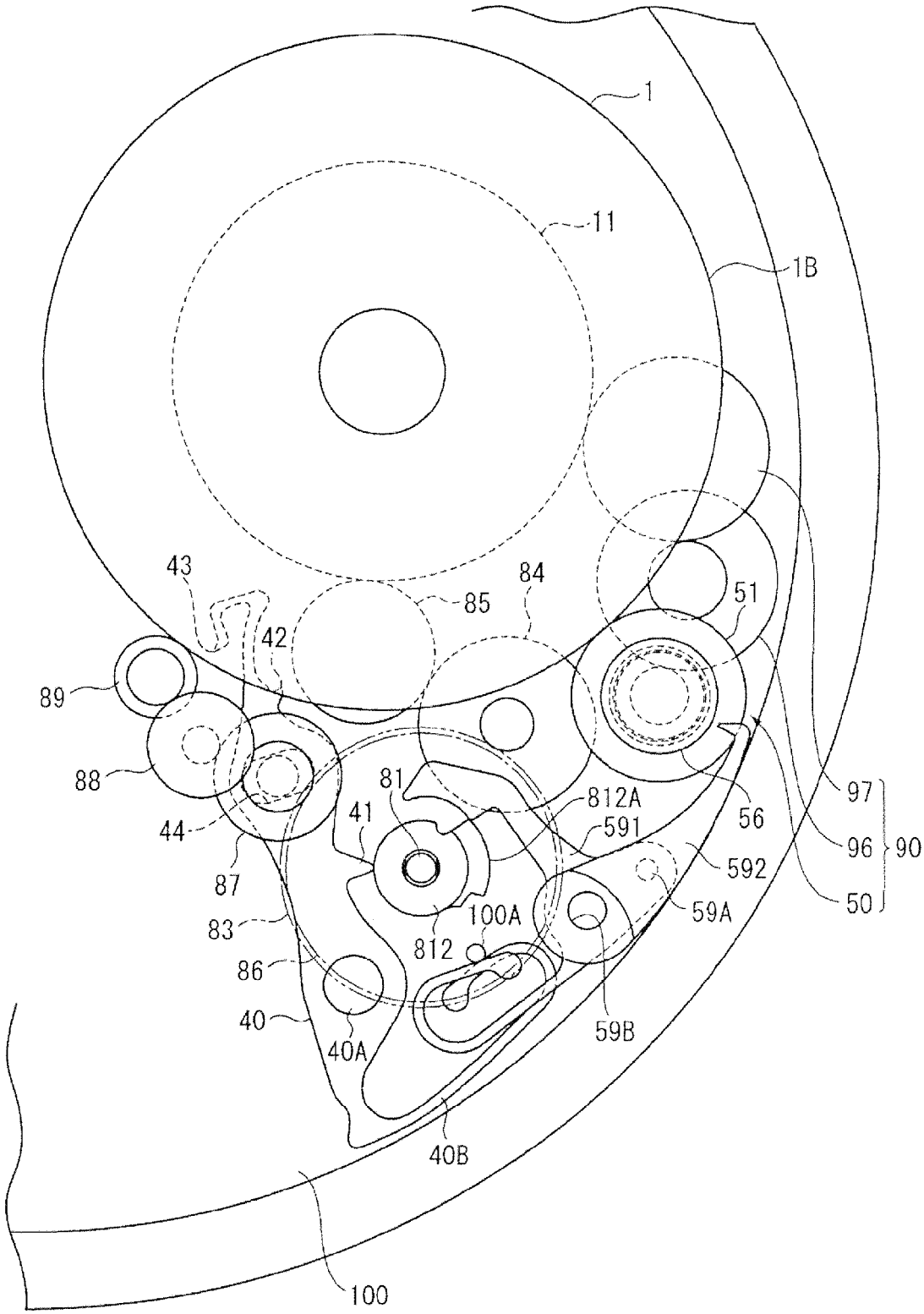
FIG. 5 is a plan view of the duration time display mechanism of the timepiece from the opposite side as the dial.
Figure 6:
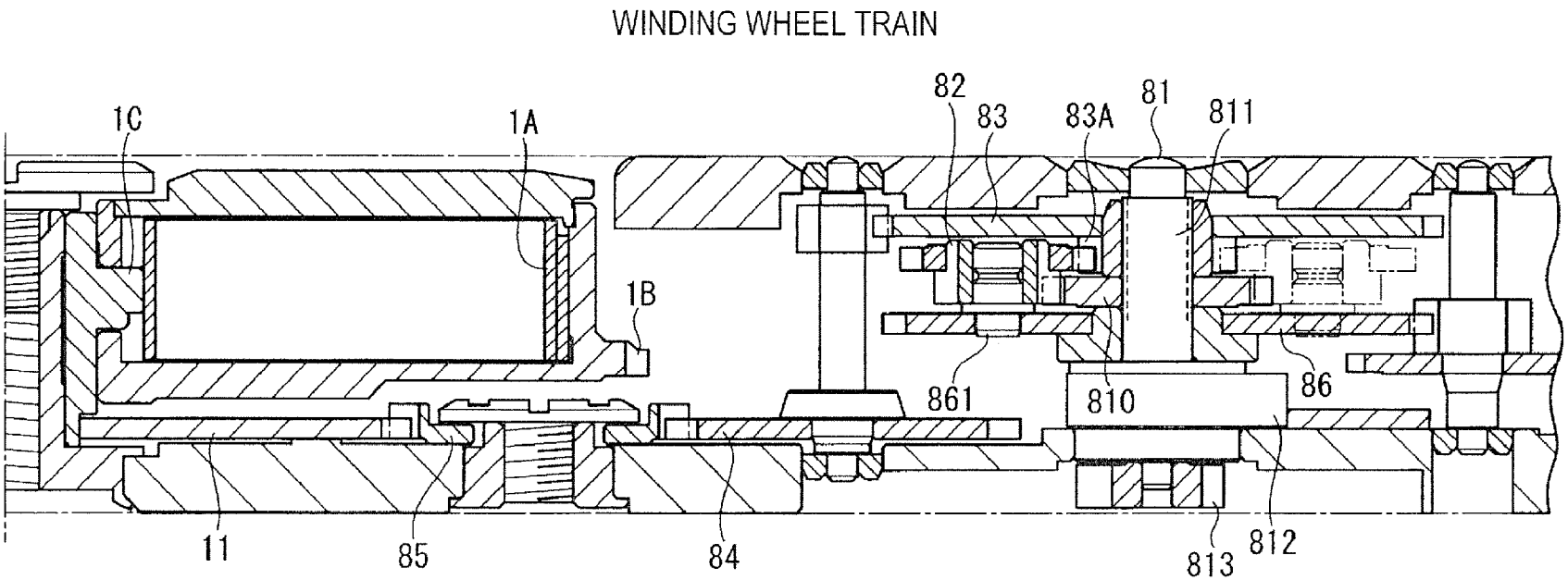
FIG. 6 is a vertical section view showing the winding wheel train of the duration time display mechanism.
Figure 7:
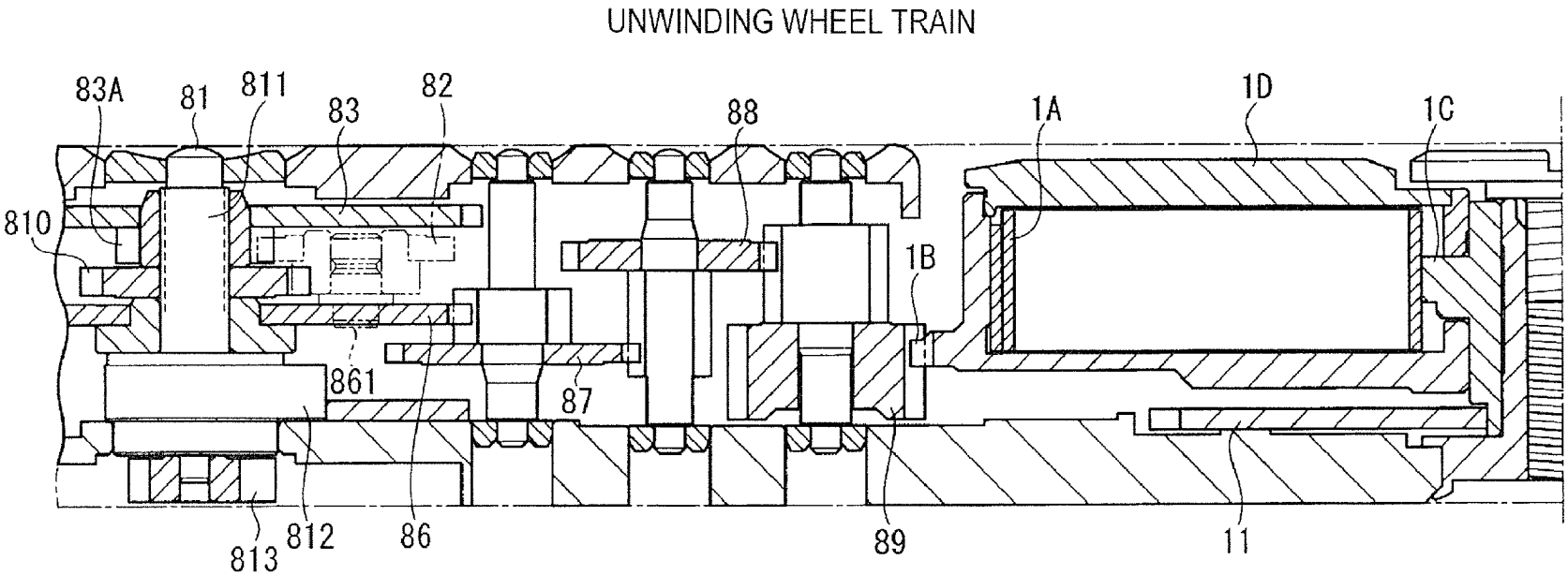
FIG. 7 is a vertical section view showing the unwinding wheel train of the duration time display mechanism.
Figure 9:
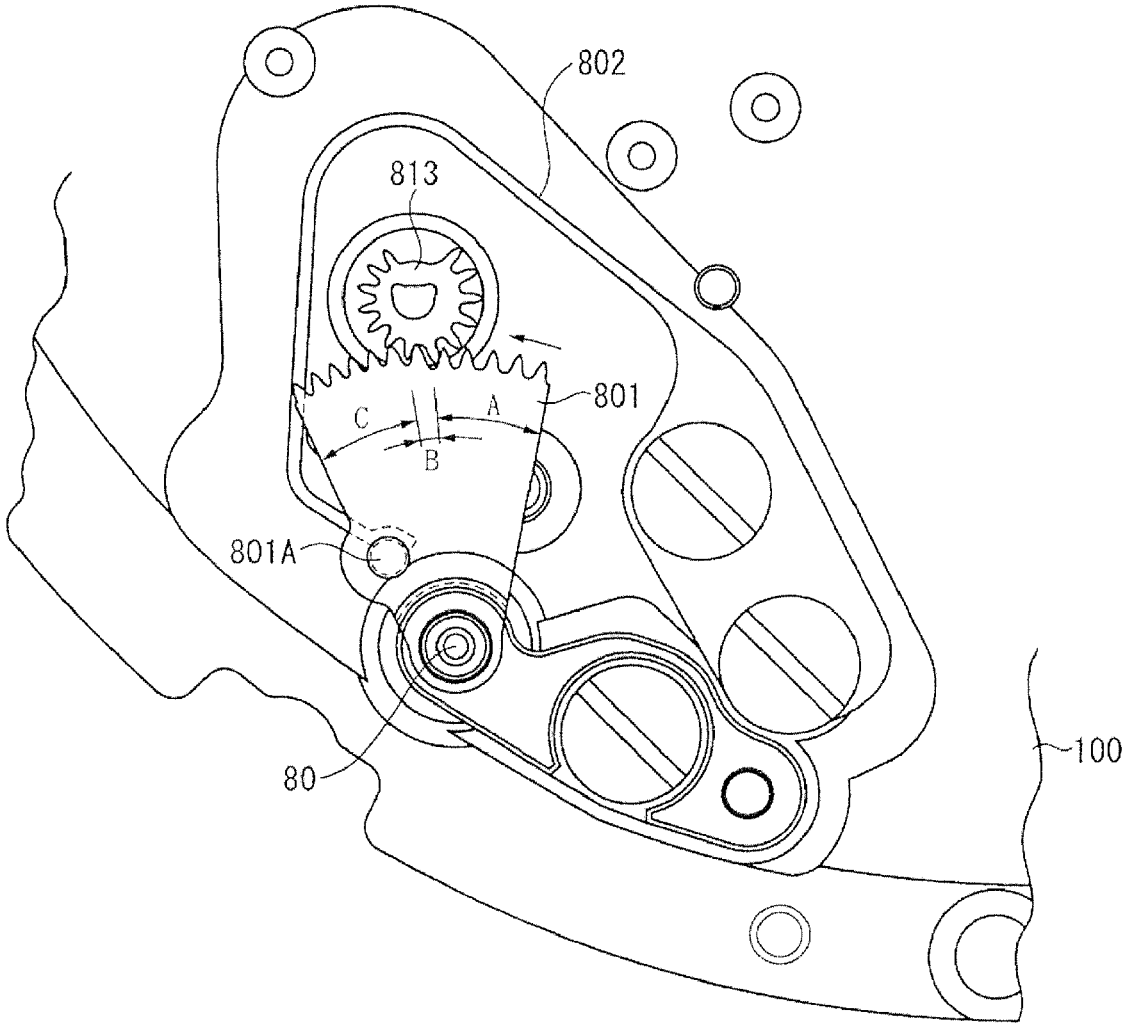
FIG. 9 is a plan view of the duration time display unit of the duration time display mechanism from the dial side.
Figure 10:
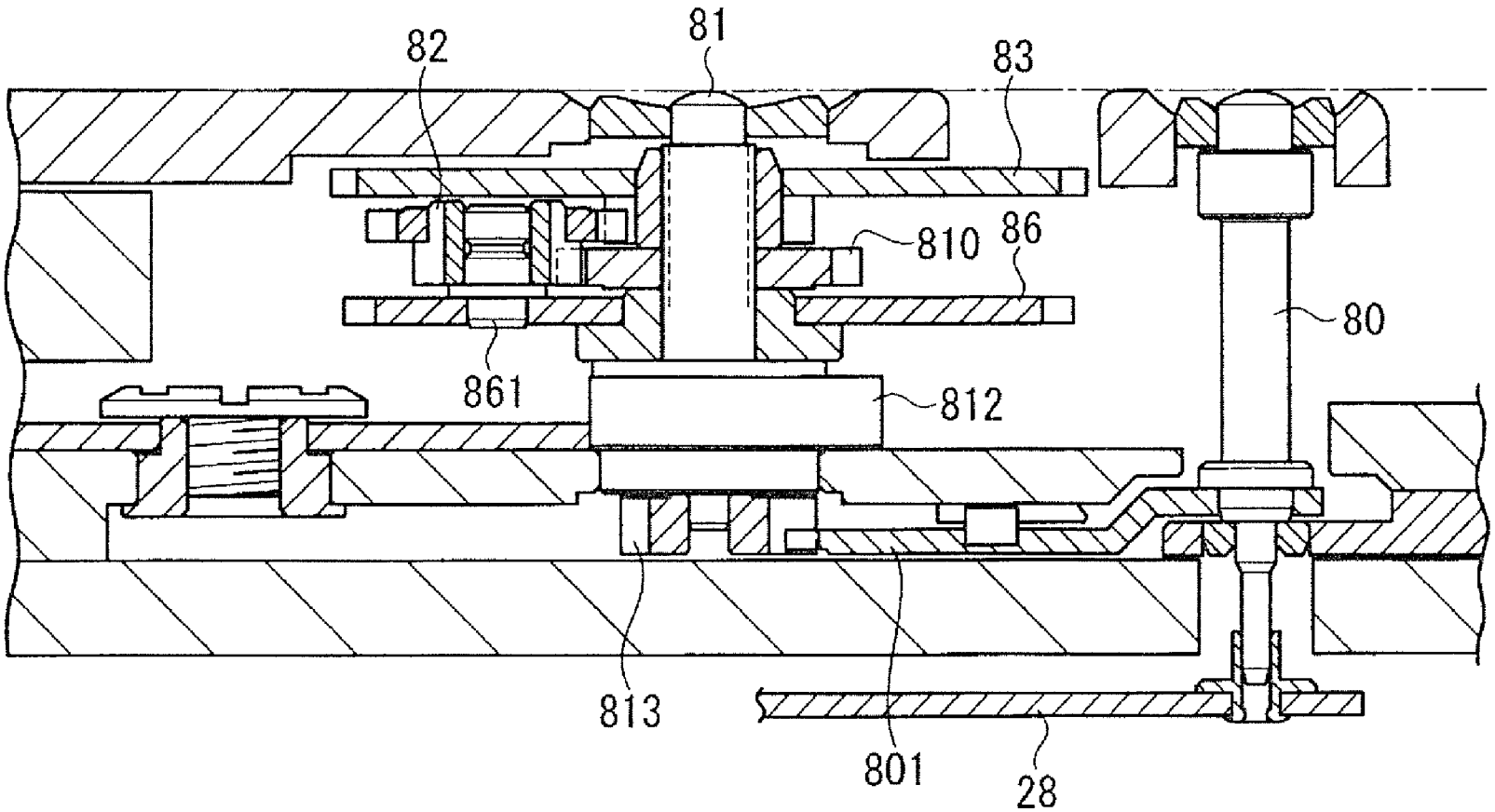
FIG. 10 is a vertical section view of the duration time display unit.

FIG. 5 is a plan view of the duration time display mechanism from the opposite side as the dial 103. FIG. 6 and FIG. 7 are vertical section views of the duration time display mechanism. The duration time display mechanism has an adding/subtracting wheel train (FIG. 5 to FIG. 7) and duration time display unit (FIG. 9 and FIG. 10). The adding/subtracting wheel train continuously adds and subtracts the winding and unwinding of the mainspring 1A, and the duration time display unit displays the number of winds (reserve power) in the mainspring 1A calculated by the adding/subtracting wheel train.

The adding/subtracting wheel train shown in FIG. 5 to FIG. 7 includes a winding wheel train and an unwinding wheel train. The winding wheel train is a winding unit that transfers torque from the ratchet wheel 11, and the unwinding wheel train is an unwinding unit that transfers torque form the barrel wheel 1B. The winding wheel train and the drive wheel train are each described next.

3-1 Winding Wheel Train Configuration

As shown in FIG. 5 and FIG. 6, the winding wheel train includes the ratchet wheel 11, a first planetary transfer wheel 85, a second planetary transfer wheel 84, a second sun wheel 83, a planetary wheel 82, a sun wheel 810, and a sun wheel stem 81 as a duration time indicating unit that rotates in unison with the sun wheel 810.

The planetary wheel 82 is axially supported on a pin 861 disposed to an intermediate planetary wheel 86, and meshes with the pinion 83A of the second sun wheel 83 and the sun wheel 810.

Figure 8A:
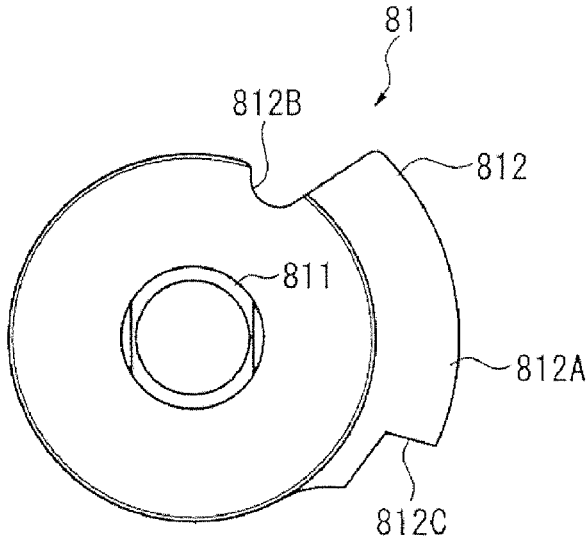
FIG. 8 shows the sun wheel stem of the duration time display mechanism.
Figure 8B:
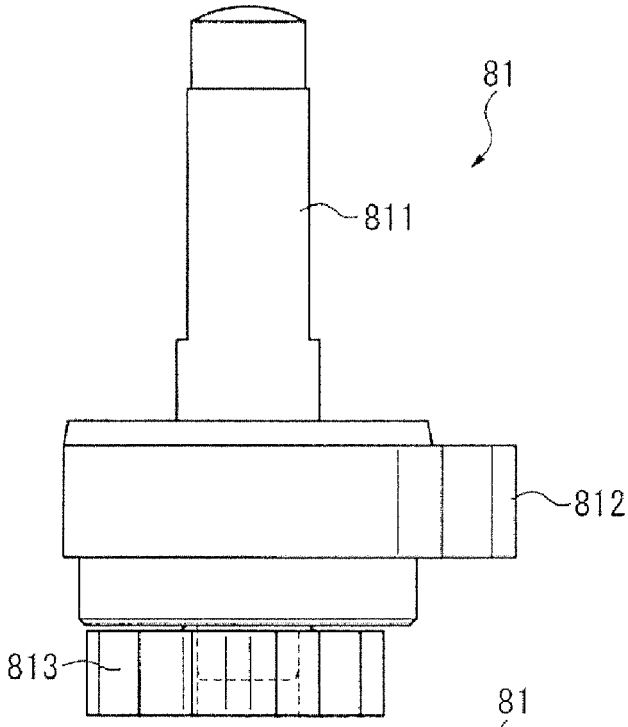
Figure 8C:
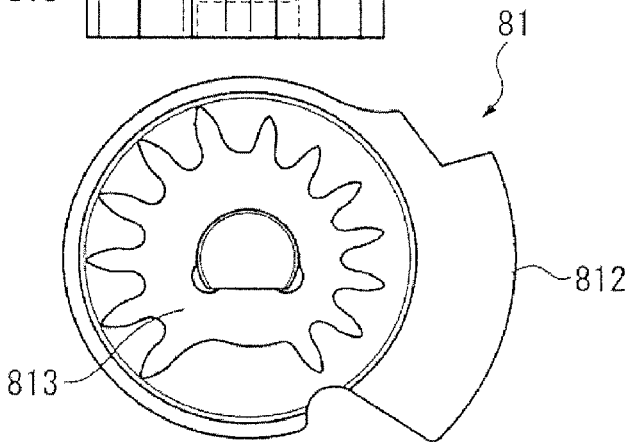

FIG. 8 shows a top view (A), a side view (B), and a bottom view (C) of the sun wheel stem 81. The sun wheel stem 81 has a track-shaped shank 811 with flats formed on a round shaft, a sun cam 812 as a duration time indicating unit, and a sun pinion 813.

The sun wheel stem 81 is inserted to a track-shaped hole formed in the sun wheel 810 (FIG. 6), thus engaging the sun wheel stem 81 and sun wheel 810 in unison.

The profile of the sun cam 812 includes a first working part 812A, a second working part 812B, and a third working part 812C. A torque limiter lever 40 and a torque transfer clutch lever 59 described below are pressed against the outside surface of the sun cam 812.

3-2 Unwinding Wheel Train Configuration

As shown in FIG. 5 and FIG. 7, the unwinding wheel train includes the barrel wheel 1B, a third planetary transfer wheel 89, a fourth planetary transfer wheel 88, a fifth planetary transfer wheel 87, and the intermediate planetary wheel 86.

3-3 Duration Time Display Unit Configuration

FIG. 9 is a plan view of the duration time display unit from the dial side, and FIG. 10 is a vertical section view of the duration time display unit.

As shown in FIG. 10, the duration time display unit includes a winding indicia wheel 80 as a winding count (power reserve) display wheel that speed reduces rotation of the sun pinion 813, and the power reserve hand 28 (FIG. 10) attached to the winding indicia wheel 80.

Rotation of the sun wheel stem 81 is communicated by the sun pinion 813 to the winding indicia wheel 80, and the number of winds left in the mainspring 1A is displayed by the power reserve hand 28.

The winding indicia wheel 80 has a fan-shaped winding indicia rack 801 that meshes with the sun pinion 813.

In this embodiment of the invention as shown in FIG. 9, the teeth of the sun pinion 813 and winding indicia wheel 80 are rendered by three different tooth forms producing different speed-reducing ratios. The three tooth forms are arranged in groups with group A having a first speed-reducing ratio of 15:92, group B having a speed-reducing ratio of 15:80, and group C having a speed-reducing ratio of 15:90.

When wheels with tooth forms rendering different speed-reducing ratios mesh, backlash must be increased in order to avoid contact with the teeth adjacent to the meshing teeth. As a result, the winding indicia rack 801 is urged counterclockwise as seen in FIG. 9 by a spring 802 disposed to the base plate 100 in this embodiment of the invention to contain the backlash. This prevents the power reserve hand 28 from bouncing. The distal end of the spring 802 is attached to a pin 801A affixed to the winding indicia rack 801.

3-4 Operation When Winding the Mainspring

When the ratchet wheel 11 (FIG. 6) turns as a result of winding the mainspring 1A, rotation of the ratchet wheel 11 is speed reduced while being communicated sequentially through the first planetary transfer wheel 85, second planetary transfer wheel 84, and second sun wheel 83. Because rotation of the barrel wheel 1B is slow, the intermediate planetary wheel 86 rendering the unwinding wheel train that turns in conjunction with the barrel wheel 1B is effectively stopped and rotation of the second sun wheel 83 is transferred from the planetary wheel 82 to the sun wheel 810. The sun wheel stem 81 therefore turns and the power reserve hand 28 rotates in the direction of the arrow in FIG. 9 (counterclockwise) in conjunction with the sun wheel stem 81.

3-5 Operation When the Mainspring Unwinds

When the mainspring 1A unwinds, the wheel train from the ratchet wheel 11 to the second sun wheel 83, which operates when the mainspring is wound, is stopped. Torque output from the mainspring 1A is communicated from the barrel wheel 1B (FIG. 7) sequentially through the third planetary transfer wheel 89, fourth planetary transfer wheel 88, and fifth planetary transfer wheel 87 to the intermediate planetary wheel 86 while being speed reduced. The planetary wheel 82 disposed to the pin 861 of the intermediate planetary wheel 86 thus rotates while revolving around the pinion 83A of the second sun wheel 83. This planetary movement of the planetary wheel 82 causes the sun wheel 810 and sun wheel stem 81 to rotate in the opposite direction as when the mainspring is being wound, and the power reserve hand 28 rotates clockwise in FIG. 9.

The sun wheel stem 81 is thus rotated in a predetermined direction by the winding wheel train (FIG. 6) when the mainspring 1A is wound, and the sun wheel stem 81 is rotated in the direction opposite the winding direction by the unwinding wheel train (FIG. 7) when the mainspring 1A unwinds. The number of winds in the mainspring 1A can be read from the rotational position of the sun wheel stem 81, which is thus adjusted up and down by the winding wheel train and the unwinding wheel train. The number of winds in the mainspring 1A is thus indicated by the rotational position of the sun wheel stem 81 used as the duration time indicating unit.

4. Torque Limiter Mechanism

The construction of the torque limiter mechanism that limits winding the mainspring 1A to a predetermined maximum number of winds is described next with reference to FIG. 11.

This torque limiter mechanism functions when the torque limiter lever 40 operates. The torque limiter lever 40 is controlled by the sun cam 812 of the sun wheel stem 81.

The torque limiter lever 40 has a shaft part 40A supported on the base plate 100, a U-shaped spring part 40B engaged by a pin 100A, a cam follower 41 that is pressed against the sun cam 812 by the urging force of the spring part 40B, a winding limiting part 42 that limits winding the mainspring 1A, and a movement limiting part 43 further described below. Note that this embodiment of the invention uses a torque limiter lever 40 having the winding limiting part 42 and movement limiting part 43 rendered in unison, but a lever having the winding limiting part and a lever having the movement limiting part could be separately controlled by the sun cam 812.

The shaft of the fifth planetary transfer wheel 87 is inserted to an oblong hole 44 formed in the torque limiter lever 40.

Figure 11:
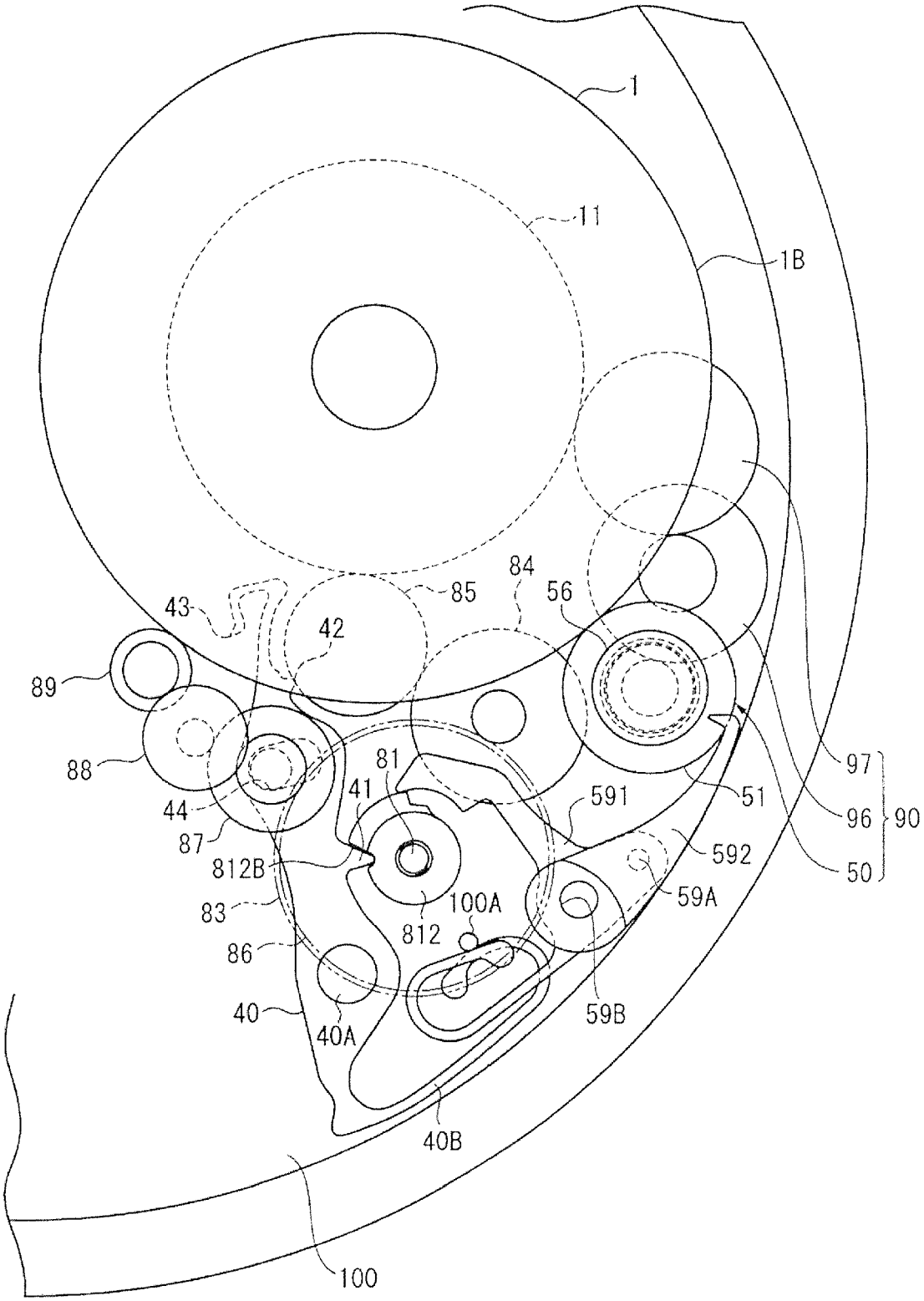
FIG. 11 is a plan view describing the torque limiter mechanism of the timepiece when winding is limited.

FIG. 11 shows the cam follower 41 of the torque limiter lever 40 engaged with the second working part 812B of the sun cam 812 when the mainspring 1A is wound to a predetermined maximum number of winds (7.7 winds in this embodiment of the invention) that is reached before the mainspring 1A is fully wound. At this time the winding limiting part 42 of the torque limiter lever 40 is inserted to a tooth form of the first planetary transfer wheel 85, thereby locking rotation of the first planetary transfer wheel 85 and preventing the mainspring 1A from being wound further.

If winding the crown continues after the mainspring 1A is wound to the maximum number of winds, the torque limiter mechanism prevents torque from the crown from affecting the period of rotor 7 rotation, causing the hands to advance and disabling speed control, or reducing the durability of the mainspring 1A.

5. Movement Stopping Mechanism

A movement stopping mechanism that limits unwinding of the mainspring 1A to a predetermined minimum number of winds is described next with reference to FIG. 12.

Figure 12:
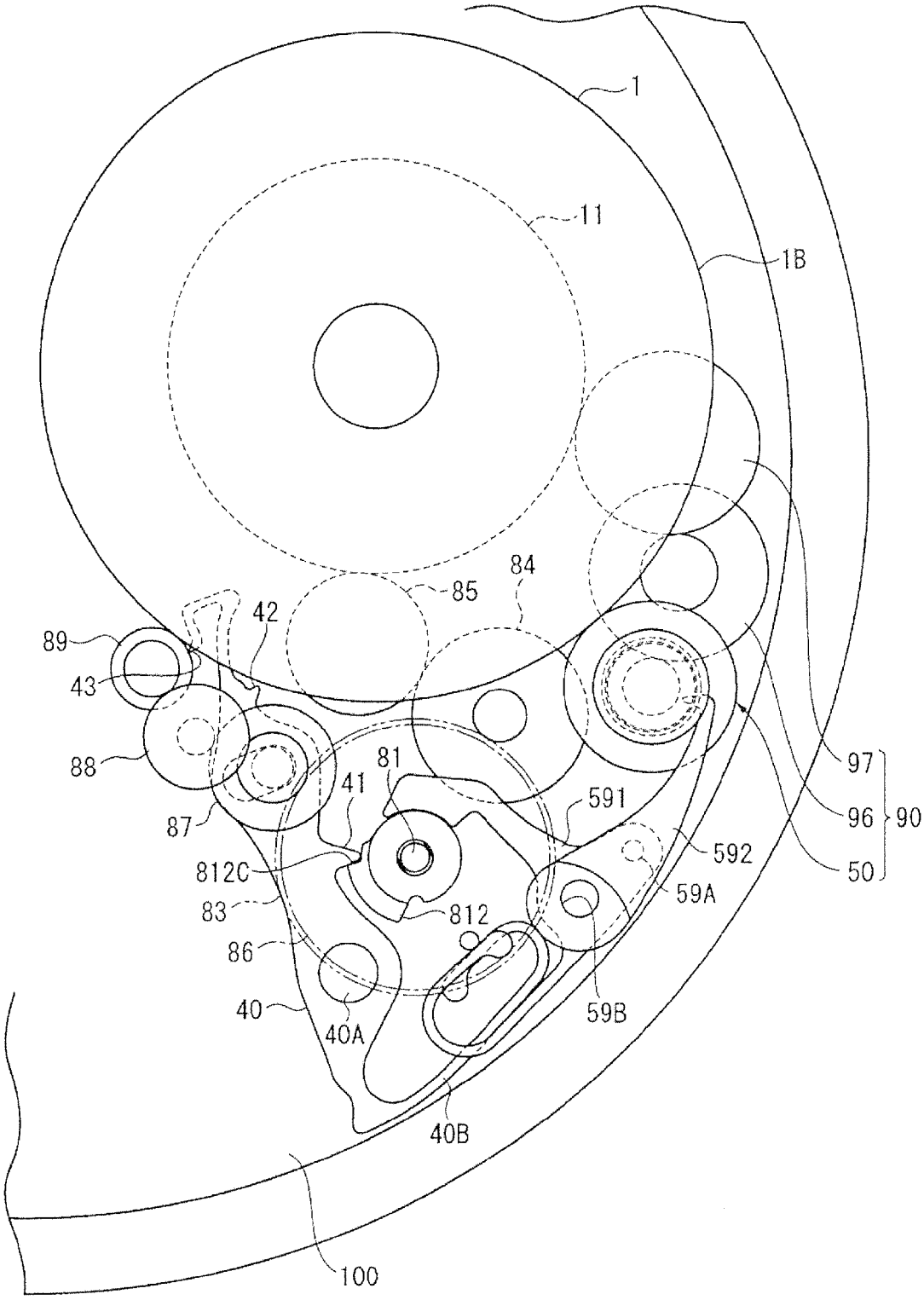
FIG. 12 is a plan view describing the torque limiter mechanism of the timepiece when the movement is stopped.

FIG. 12 shows the positions reached after the sun wheel stem 81 rotates approximately 245 degrees clockwise from the position shown in FIG. 11, and the cam follower 41 of the torque limiter lever 40 engages the third working part 812C of the sun cam 812. At this time the sun wheel stem 81 indicates that the number of winds in the mainspring 1A is the lower limit of 2.1 winds, the movement limiting part 43 of the torque limiter lever 40 enters a tooth form of the third planetary transfer wheel 89, and rotation of the third planetary transfer wheel 89 is thereby locked. As a result, rotation of the third planetary transfer wheel 89 and the wheel train including the barrel wheel 1B stops, the drive wheel train including wheels 2 to 6 stops, and movement of the hands therefore stops.

By thus stopping the movement before the output torque of the mainspring 1A drops below the level required to keep the rotor 7 rotating 8 revolutions per second, the movement stopping mechanism prevents displaying the incorrect time as a result of the hands slowing down.

The torque limiter mechanism and movement stopping mechanism thus limit rotation of the sun cam 812 to a range between the position where the cam follower 41 of the torque limiter lever 40 engages the second working part 812B and the position where the cam follower 41 engages the third working part 812C. The usable number of winds in the mainspring 1A is therefore set to the range from 2.1 winds to 7.7 winds.

6. Torque Return Mechanism

The torque return unit of the torque return mechanism is described next.

6-1 Basic Configuration of the Torque Return Mechanism

Figure 13:
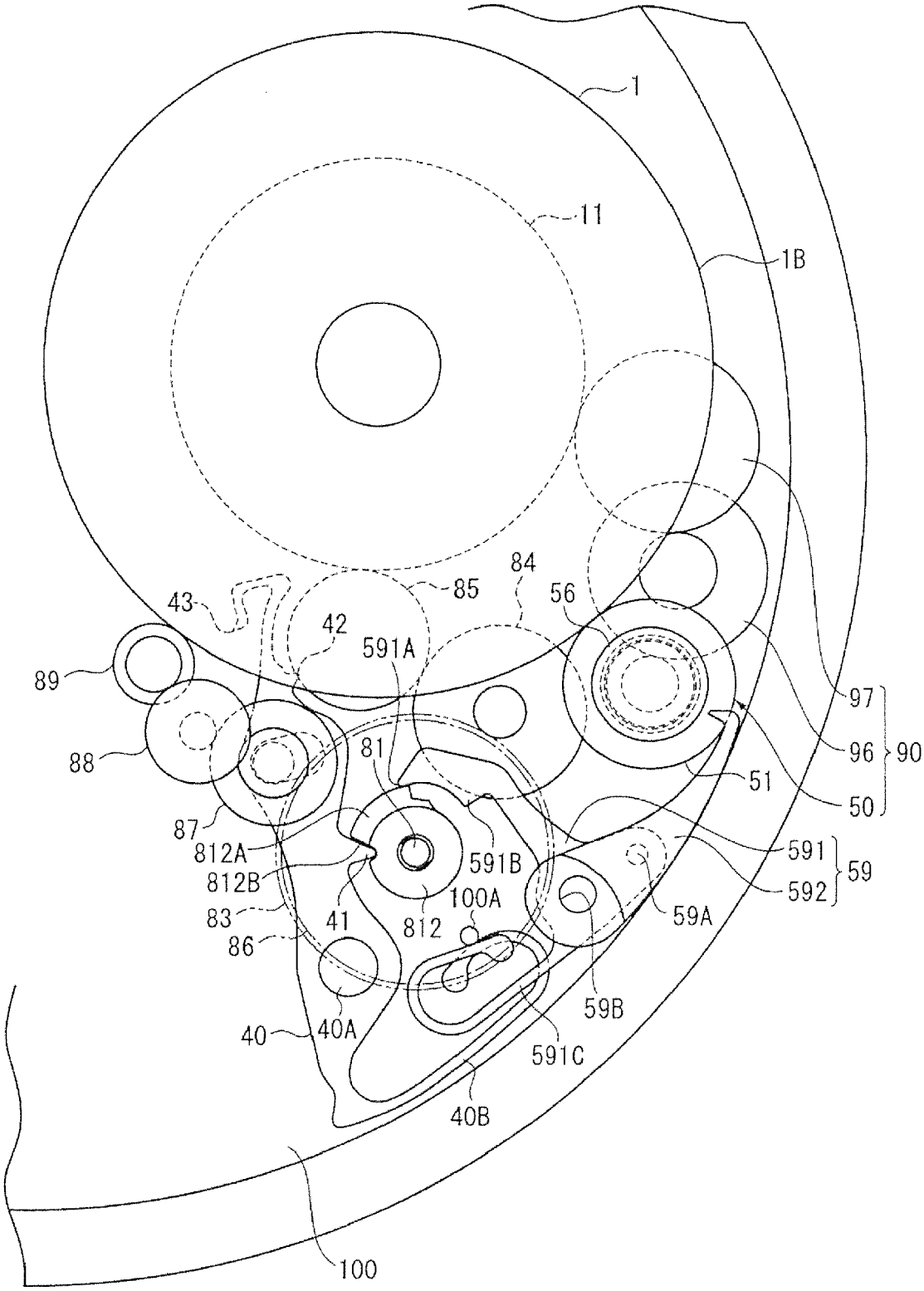
FIG. 13 is a plan view describing the torque return mechanism of the timepiece when transmitting torque.
Figure 14:
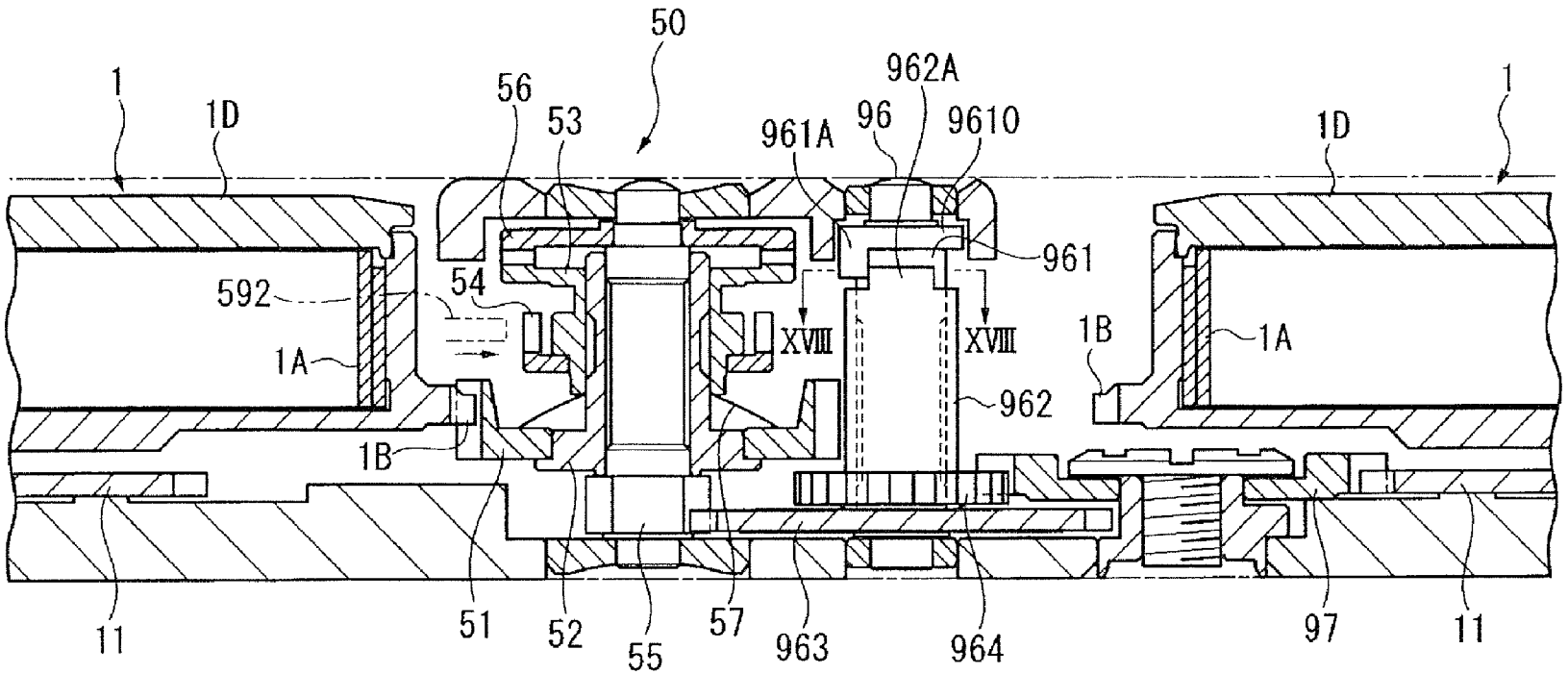
FIG. 14 is a vertical section view showing the torque return unit of the torque return mechanism when transmitting torque.

FIG. 13 is a plan view showing the torque limiter lever 40 described above and the torque return unit 90. FIG. 14 is a vertical section view of the torque return unit 90. Note that the same barrel 1 is shown on the right and left sides in FIG. 14.

The torque return unit 90 is a wheel train of three wheels connecting the barrel wheel 1B and the ratchet wheel 11. More specifically, this wheel train includes a torque return wheel 50 that meshes with the barrel wheel 1B, a first torque return transfer wheel 96, and a second torque return transfer wheel 97 that engages the ratchet wheel 11. By rendering the torque return unit 90 with an odd number of wheels, the barrel wheel 1B and ratchet wheel 11 must rotate in the same direction.

The speed-reducing ratio from the barrel wheel 1B to the ratchet wheel 11 is 5.0 in this embodiment of the invention, and part of the torque of the mainspring 1A output from the barrel wheel 1B is communicated through the torque return wheel 50, first torque return transfer wheel 96, and second torque return transfer wheel 97 to the ratchet wheel 11. This winds the mainspring 1A.

The specific speed-reducing ratios (SRR) are shown below. Values in parentheses indicate the number of teeth.

barrel wheel (147)–torque receiver wheel (37), *SRR*=0.25 torque return pinion (10)–first torque return transfer wheel (39), *SRR*=3.9 first torque return transfer pinion (10)–second torque return transfer wheel (22), *SRR*=2.2 second torque return transfer wheel (22)–ratchet wheel (51), *SRR*=2.3

The ratchet wheel 11 is thus wound 0.2 revolution when the barrel wheel 1B turns one revolution.

Because 1/0.8=1.25, the torque return unit 90 increases the duration time of the mainspring 1A 1.25 times.

6-2 Torque Transfer Clutch Unit

This embodiment of the invention has a torque transfer clutch mechanism that returns torque only when the number of winds in the mainspring 1A is greater than a predetermined reference number of winds (5 winds in this embodiment of the invention), and disengages the barrel wheel 1B and ratchet wheel 11 when the number of winds in the mainspring 1A is less than this reference count instead of constantly returning torque from the mainspring 1A.

This torque transfer clutch mechanism includes the sun cam 812 described above (FIG. 8), the torque transfer clutch lever 59 shown in FIG. 13, and the torque return wheel 50.

6-2-1 Configuration of the Torque Return Wheel

As shown in FIG. 14, the torque return wheel 50 includes seven components: a torque receiving wheel 51 that meshes with the barrel wheel 1B, a substantially square tubular shaft 52 that is pressed into the torque receiving wheel 51, a first clutch member 53 that is inserted over the shaft 52, a clutch operating cam 54 that is pressed into the first clutch member 53, a torque return pinion 55 as a torque return wheel, a second clutch member 56 that is pressed onto the torque return pinion 55, and a disc spring 57 that urges the first clutch member 53 to the second clutch member 56.

Figure 15A:
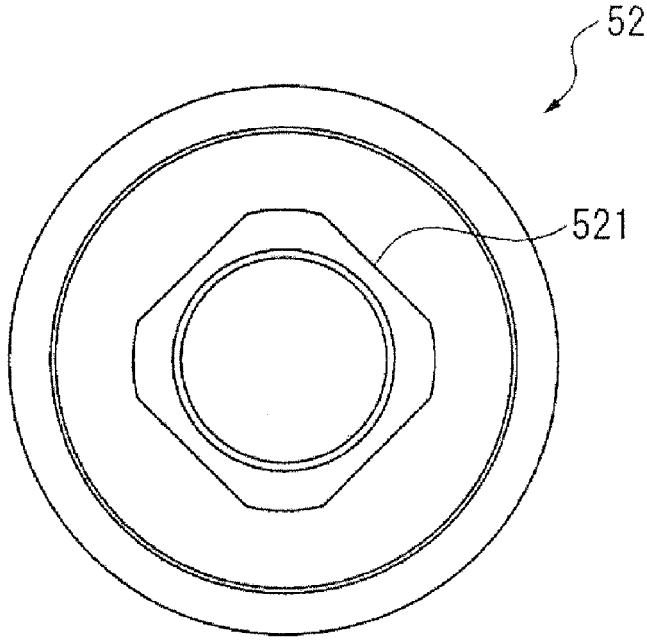
FIG. 15 shows the torque return wheel of the torque return unit.
Figure 15B:
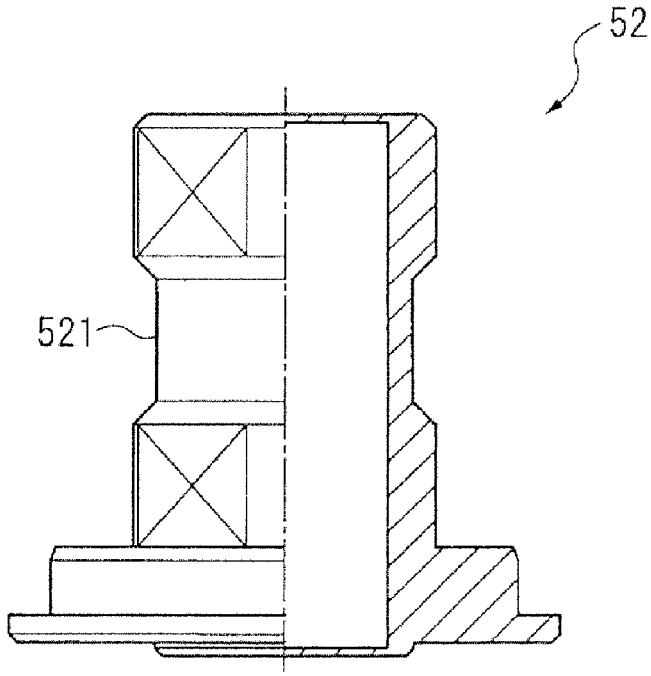

FIG. 15 shows the shaft 52 from the top (A) and side (B) The shaft 52 has a square shank 521 that is substantially square in section, and guides the first clutch member 53 along the axial direction of the square shank 521.

Figure 16:
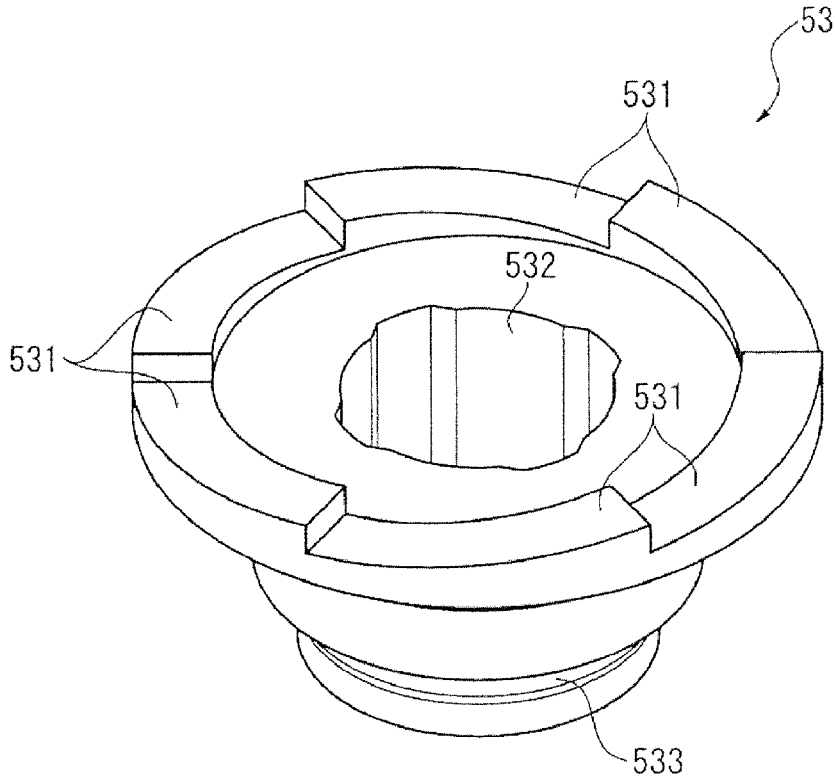
FIG. 16 is an oblique view showing the first clutch member of the torque return wheel.

FIG. 16 is an oblique view of the first clutch member 53. The first clutch member 53 has six triangular teeth 531, a substantially square hole 532 into which the shaft 52 is inserted, and a groove 533 formed around the shaft part. The second clutch member 56 also has six triangular teeth identically to the first clutch member 53, and the urging force of the disc spring 57 causes the triangular teeth of the first and second clutch members 53 and 56 to engage.

When torque is communicated from the barrel wheel 1B to the torque receiving wheel 51, the triangular teeth of the first and second clutch members 53 and 56 engage, and torque from the barrel wheel 1B is transferred to the ratchet wheel 11. When the mainspring 1A is wound by turning the crown and rotation from the ratchet wheel 11 is communicated to the first clutch member 53, the triangular teeth of the first and second clutch members 53 and 56 slide so that the first clutch member 53 moves vertically, and the barrel wheel 1B and ratchet wheel 11 are disengaged. The first and second clutch members 53 and 56 thus render a slip mechanism that interrupts transfer of torque from the ratchet wheel 11 when winding the mainspring.

Figure 17:
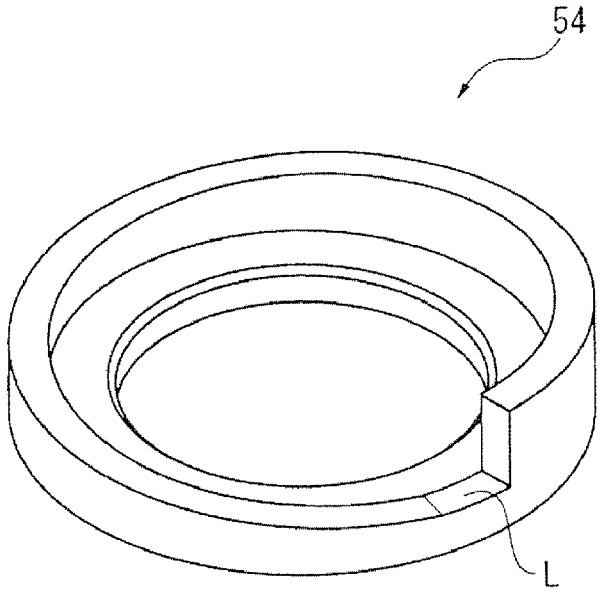
FIG. 17 is an oblique view of the clutch operating cam of the torque return wheel.

FIG. 17 is an oblique view of the clutch operating cam 54. The clutch operating cam 54 is formed with a spiral step winding 360 degrees.

6-2-2 Configuration of the Torque Transfer Clutch Lever

As shown in FIG. 13, the torque transfer clutch lever 59 in this embodiment of the invention is a two-part structure including a sun-engaging lever 591 that engages the sun cam 812, and a clutch-engaging lever 592 that engages the clutch operating cam 54 (FIG. 14). The sun-engaging lever 591 and clutch-engaging lever 592 are attached by a pin 59A, and axially supported on the base plate 100 by a stud 59B.

The sun-engaging lever 591 includes a spring part 591C that engages the pin 10A, and cam followers 591A and 591B that are pressed against the sun cam 812 by the urging force of the spring part 591C.

6-2-3 Configuration of the First Torque Return Transfer Wheel

The first torque return transfer wheel 96 is described next with reference to FIG. 14.

The first torque return transfer wheel 96 includes a connector shaft, a first shaft receiver wheel 963, and a second shaft return wheel 964. The connector shaft has two parts, a first shaft 961 and a tubular second shaft 962 inside of which the first shaft 961 is inserted. The first shaft receiver wheel 963 is fixed to the first shaft 961, meshes with the torque return pinion 55, and renders the first shaft receiver wheel of the accompanying claims. The second shaft return wheel 964 is fixed to the second shaft 962 and meshes with the second torque return transfer wheel 97.

A transfer wheel 9610 is fastened to the first shaft 961. A shoulder 961A that protrudes toward the second shaft 962 is formed along a part (through a range of 90 degrees in this embodiment) of the circumference of the transfer wheel 9610. A shoulder 962A that protrudes toward the first shaft 961 is also formed on the end of the second shaft 962 along a part (through a range of 90 degrees in this embodiment) of the circumference of the second shaft 962.

Figure 18:
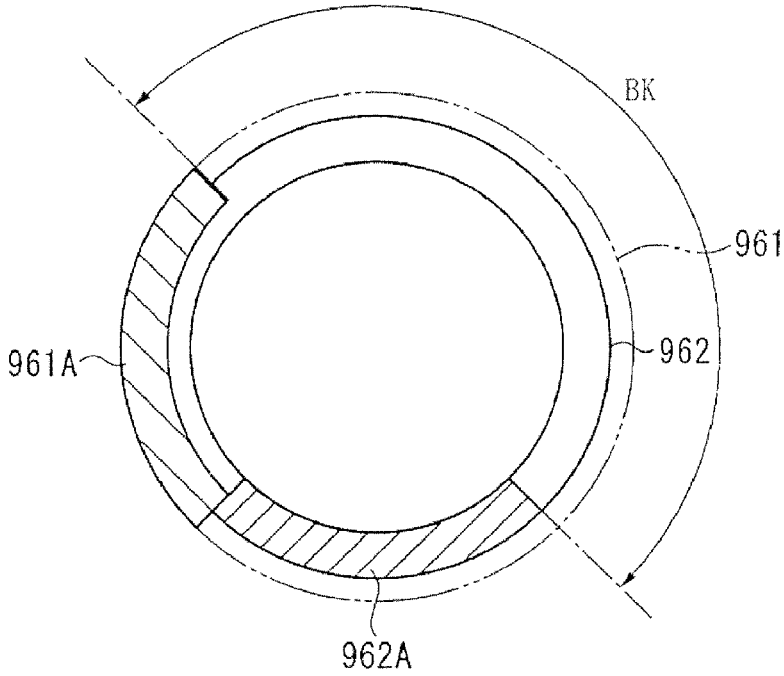
FIG. 18 is a section view through line XVIII-XVIII in FIG. 14 of the first shaft and second shaft of the torque return first transmission wheel when not engaged.

FIG. 18 is a section view of the first shaft 961 and second shaft 962 through line XVIII-XVIII in FIG. 14. The shoulders 961A and 962A of the first and second shafts protrude in opposing directions from opposite sides of the line XVIII-XVIII in FIG. 14, and the first shaft 961 and second shaft 962 therefore have a backlash BK of 180 degrees.

Note that this backlash BK does not need to be imparted to the first torque return transfer wheel 96, and can be imparted to any of the torque return wheel 50, first torque return transfer wheel 96, and second torque return transfer wheel 97 parts of the torque return unit 90.

When the mainspring 1A is wound by turning the crown, for example, and the ratchet wheel 11 rotates, the rotation is communicated sequentially to the second torque return transfer wheel 97 and second shaft return wheel 964, and the second shaft 962 turns clockwise in FIG. 18. As a result, the shoulders 961A and 962A engage as shown in FIG. 18, and rotation is transferred from the first torque return transfer wheel 96 to the torque return wheel 50. However, because the slip mechanism of the torque return wheel 50 described above works when the mainspring 1A is wound by turning the crown, for example, rotation of the ratchet wheel 11 is not transferred to the barrel wheel 1B.

Figure 19:
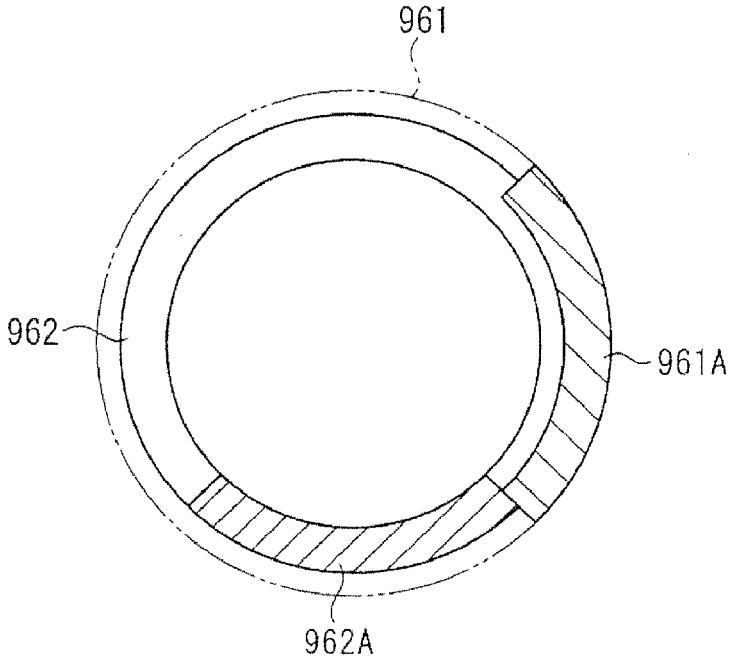
FIG. 19 is a section view through line XVIII-XVIII in FIG. 14 of the first shaft and second shaft of the torque return first transmission wheel when engaged.

When the mainspring 1A unwinds from the position shown in FIG. 18 and the movement is driven, rotation is communicated from the torque return pinion 55 of the torque return wheel 50 to the first shaft 961, and the first shaft 961 rotates clockwise in FIG. 18 while the second shaft 962 remains stationary. For the 4.8 hours required for the first shaft 961 to turn 180 degrees from the position shown in FIG. 18 to where the shoulders 961A and 962A of the first shaft and second shaft engage as shown in FIG. 19, torque transfer is interrupted and the torque return mechanism does not work.

6-3 Engaging and Disengaging Torque Transfer

Engaging and disengaging torque transfer by means of the torque return unit 90 according to this embodiment of the invention is described next.

FIG. 13 shows the positions when the mainspring 1A is wound by the crown, for example, and the winding limiting part 42 of the torque limiter lever 40 locks the first planetary transfer wheel 85. The cam follower 41 of the torque limiter lever 40 is also engaged with the second working part 812B of the sun cam 812. The cam follower 591A of the sun-engaging lever 591 of the torque transfer clutch lever 59 is also engaged with the first working part 812A of the sun cam 812. The distal end part of the clutch-engaging lever 592 is separated from the torque return wheel 50 as shown in FIG. 13 and FIG. 14, and the first and second clutch members 53 and 56 are engaged. The torque return wheel 50 can thus transfer torque, but the connection between the barrel wheel 1B and ratchet wheel 11 is disengaged by the torque return unit 90 as a result of the backlash BK (FIG. 18) of the first and second shafts 961 and 962 of the first torque return transfer wheel 96.

When the mainspring 1A then unwinds from this position and the hands are moved, the sun wheel stem 81 rotates approximately 5 degrees in 1 hour clockwise as seen in FIG. 13, and the winding limiting part 42 disengages the first planetary transfer wheel 85 in approximately 2 hours. Once winding the mainspring 1A is thus no longer restricted, the first shaft 961 and second shaft 962 of the first torque return transfer wheel 96 engage. The torque return unit 90 therefore connects the barrel wheel 1B and the ratchet wheel 11. As a result, the torque return unit 90 returns a portion of the torque from the mainspring 1A to the mainspring 1A, and the mainspring 1A is thus wound.

Figure 20:
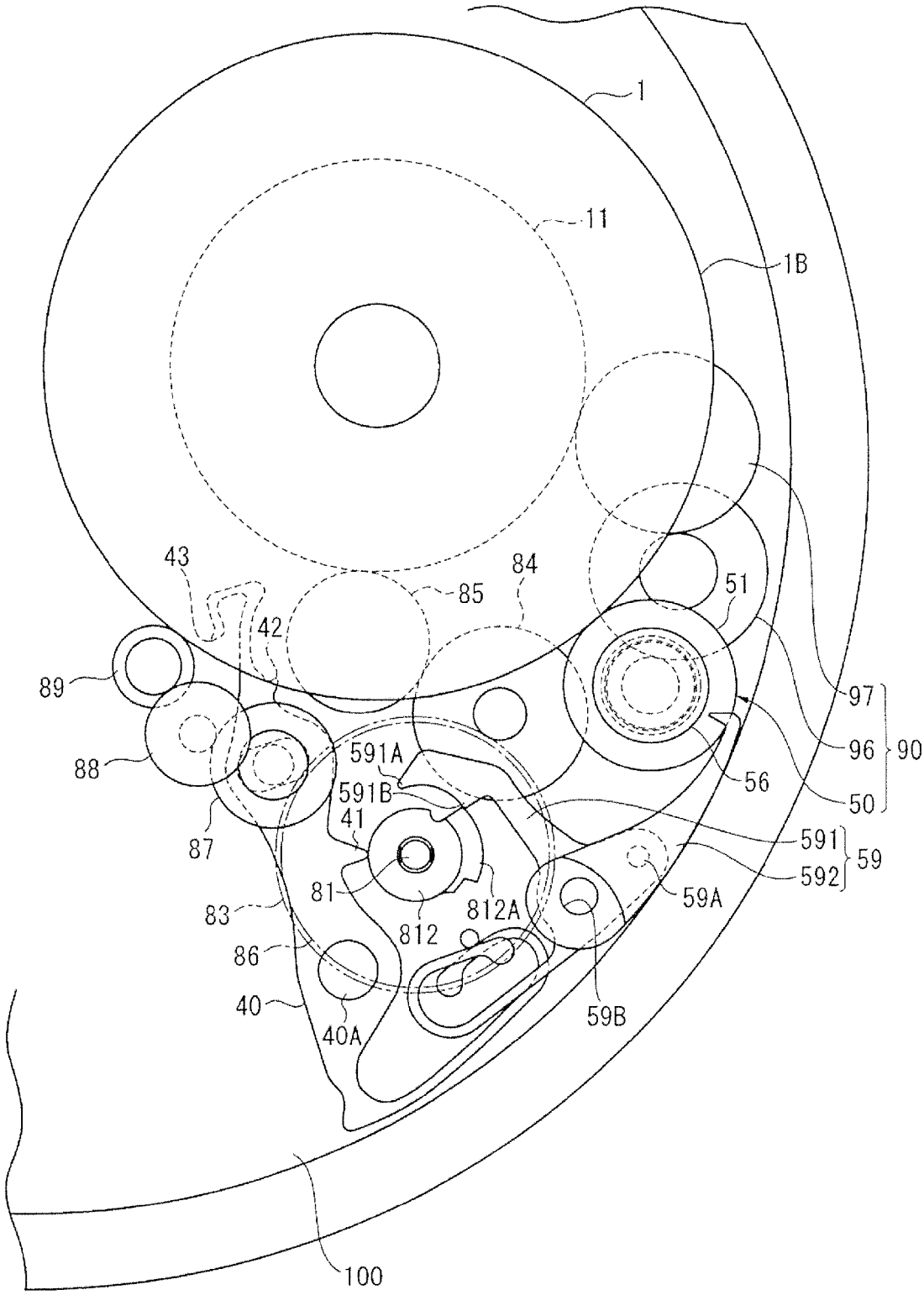
FIG. 20 is a plan view of the torque return unit just before the torque transmission state is changed by the torque transmission clutch lever.

When the sun cam 812 rotates clockwise in FIG. 13 from the position where the cam follower 591A of the torque transfer clutch lever 59 engages the first working part 812A of the sun cam 812 as shown in FIG. 13, the contact point of the sun cam 812 changes from the cam follower 591A to the cam follower 591B, and the cam follower 591B is pressed against the first working part 812A of the sun cam 812 as shown in FIG. 20. When positioned as shown in FIG. 20 the distal end part of the clutch-engaging lever 592 remains disengaged from the torque return wheel 50 (FIG. 14), and torque transfer by the torque return unit 90 remains engaged.

Figure 22:
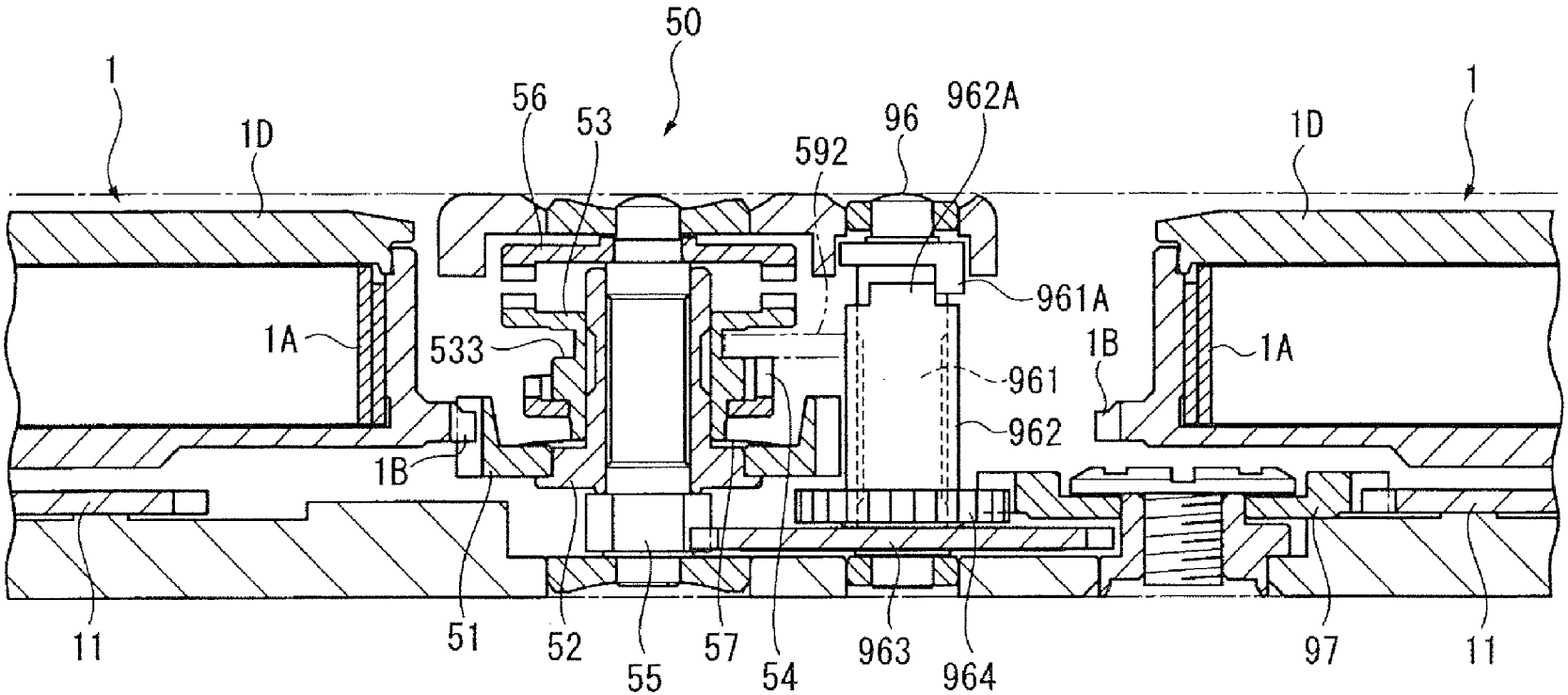
FIG. 22 is a vertical section view of the torque return unit when torque is not transmitted.
Figure 23:
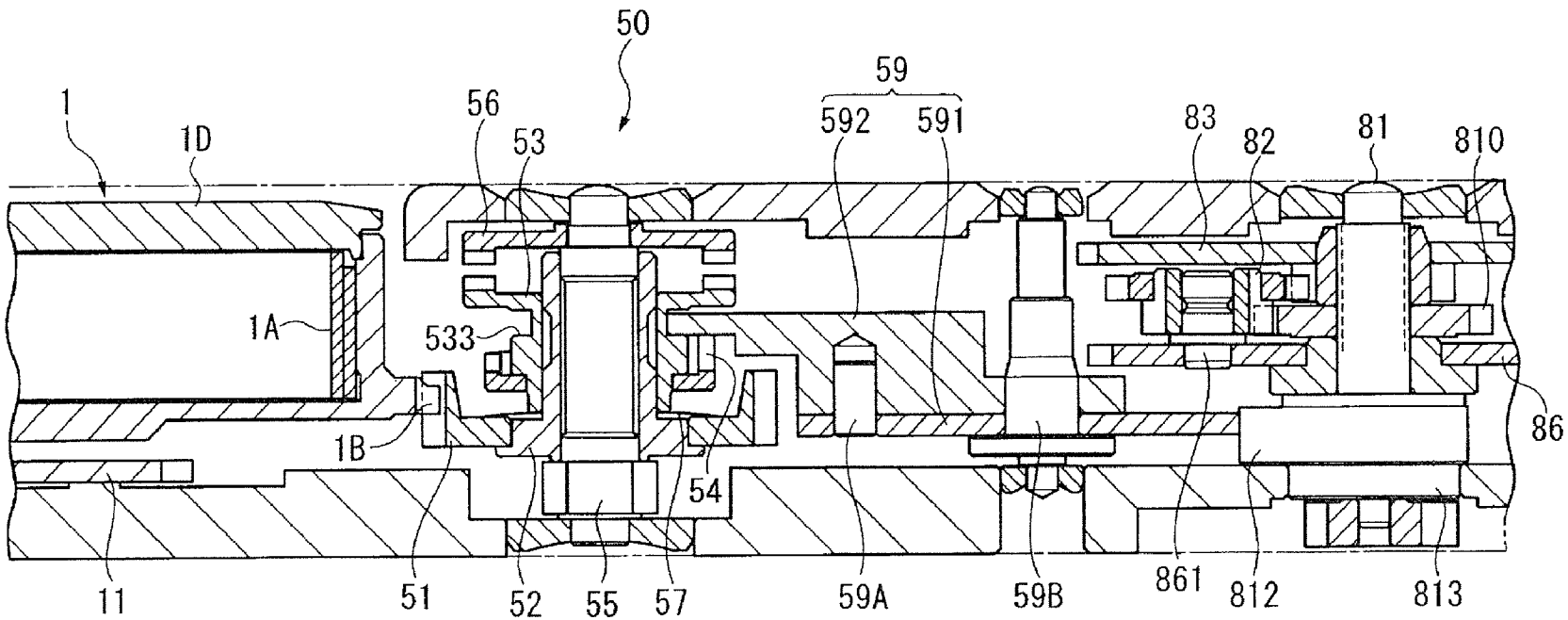
FIG. 23 is a vertical section view of the torque return unit when torque is not transmitted from a different direction than shown in FIG. 22.

When the sun cam 812 turns further clockwise from the position in FIG. 20 to the point where the indicated number of winds is the reference number of 5 winds (that is, the sun cam 812 rotates 120 degrees from the position in FIG. 13), the cam follower 591B of the sun-engaging lever 591 drops off the first working part 812A of the sun cam 812 as shown in FIG. 20, and the torque transfer clutch lever 59 rotates counterclockwise in FIG. 20. The distal end part of the clutch-engaging lever 592 moves in the direction of the arrow in FIG. 14 and rests on the lowest part (L in FIG. 17) of the spiral step of the clutch operating cam 54. The clutch-engaging lever 592 thus starts to disengage the first and second clutch members 53 and 56. As the clutch operating cam 54 rotates in conjunction with the slow rotation of the barrel wheel 1B, the clutch operating cam 54 descends relative to the clutch-engaging lever 592 as shown in FIG. 22 and FIG. 23. The first clutch member 53 descends against the force of the spring with the clutch operating cam 54, thus disengaging the first and second clutch members 53 and 56 and disengaging torque transfer between the barrel wheel 1B and ratchet wheel 11 by means of the torque return unit 90. The distal end of the clutch-engaging lever 592 enters the groove 533 when the first clutch member 53 descends, and thus holds the first and second clutch members 53 and 56 apart.

Figure 21:
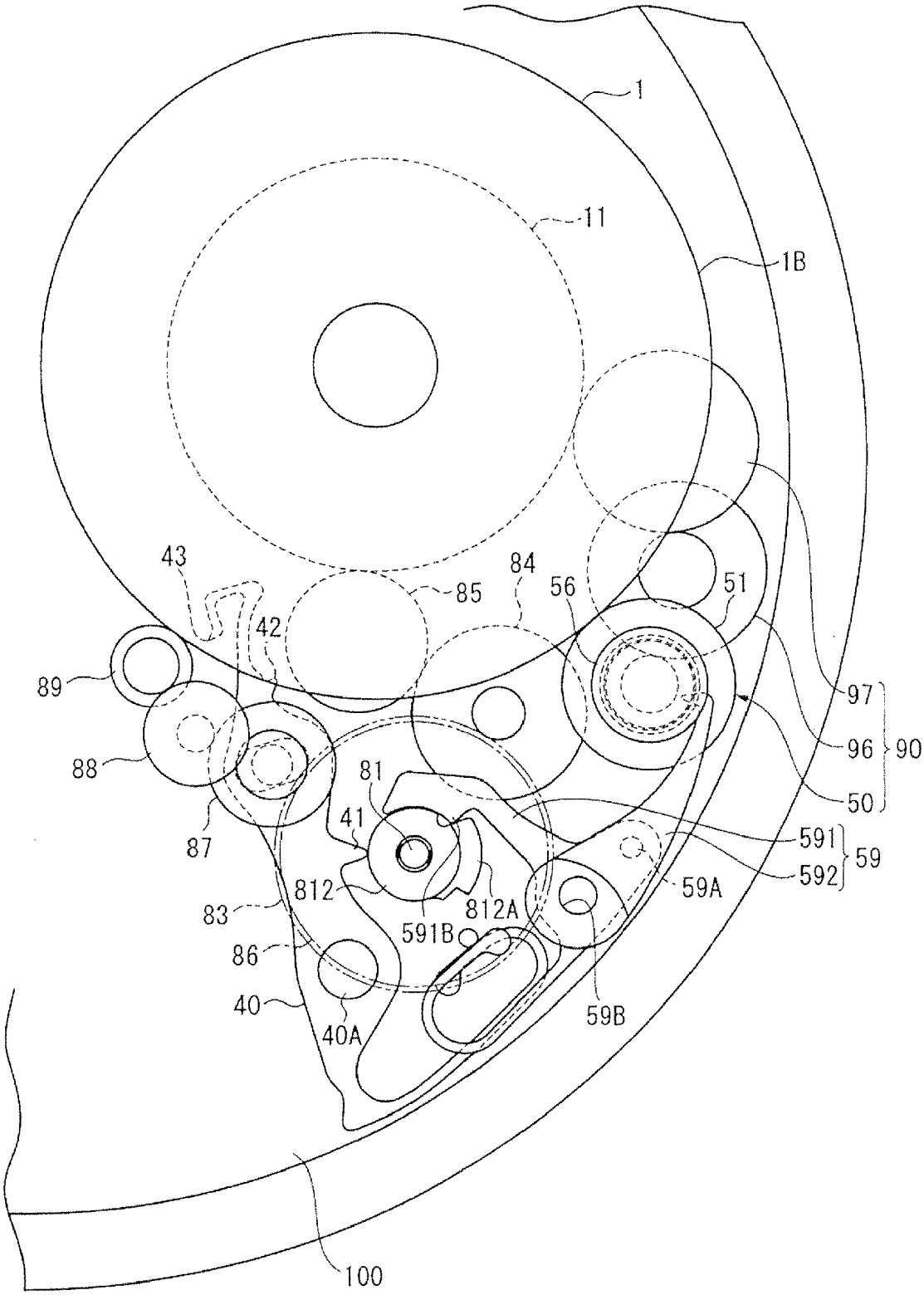
FIG. 21 is a plan view of the torque return unit when torque transmission by the torque return lever is disengaged by the torque transmission clutch lever.

When the sun cam 812 rotates further clockwise from the position in FIG. 21 and the number of winds in the mainspring 1A goes to the lower limit of 2.1 winds, the movement limiting part 43 locks the third planetary transfer wheel 89 as shown in FIG. 12. The movement thus stops.

6-4 Movement of the Power Reserve Hand

As described above, when the sun wheel stem 81 is at a rotational position greater than the reference number of winds, that is, before the torque transfer clutch lever 59 disengages, the mainspring 1A is wound 0.2 winds by the torque return unit 90 during each one revolution of the barrel wheel 1B. When the sun wheel stem 81 rotates to a position less than this reference number of winds, that is, after the torque transfer clutch lever 59 disengages, the mainspring 1A is not wound. As a result, rotation of the sun wheel stem 81 is 20%, that is, the amount the mainspring 1A is wound, slower before the torque transfer clutch lever 59 disengages than after. The speed-reducing ratio is therefore 20% lower when the sun pinion 813 engages the A group of teeth on the winding indicia rack 801 than when it engages the C group of teeth (FIG. 9). The power reserve hand 28 therefore moves uniformly throughout the duration time of the mainspring 1A.

The B group of teeth is provided in this embodiment of the invention so that meshing of the sun pinion 813 and winding indicia rack 801 can move smoothly from the group A tooth forms to the group C tooth forms. This B group of teeth could be omitted.

Using tooth forms with different speed-reducing ratios is not essential, and the scale on the dial pointed to by the power reserve hand 28 could vary according to the speed of the sun pinion 813.

7. Mainspring Duration Time

Figure 24:
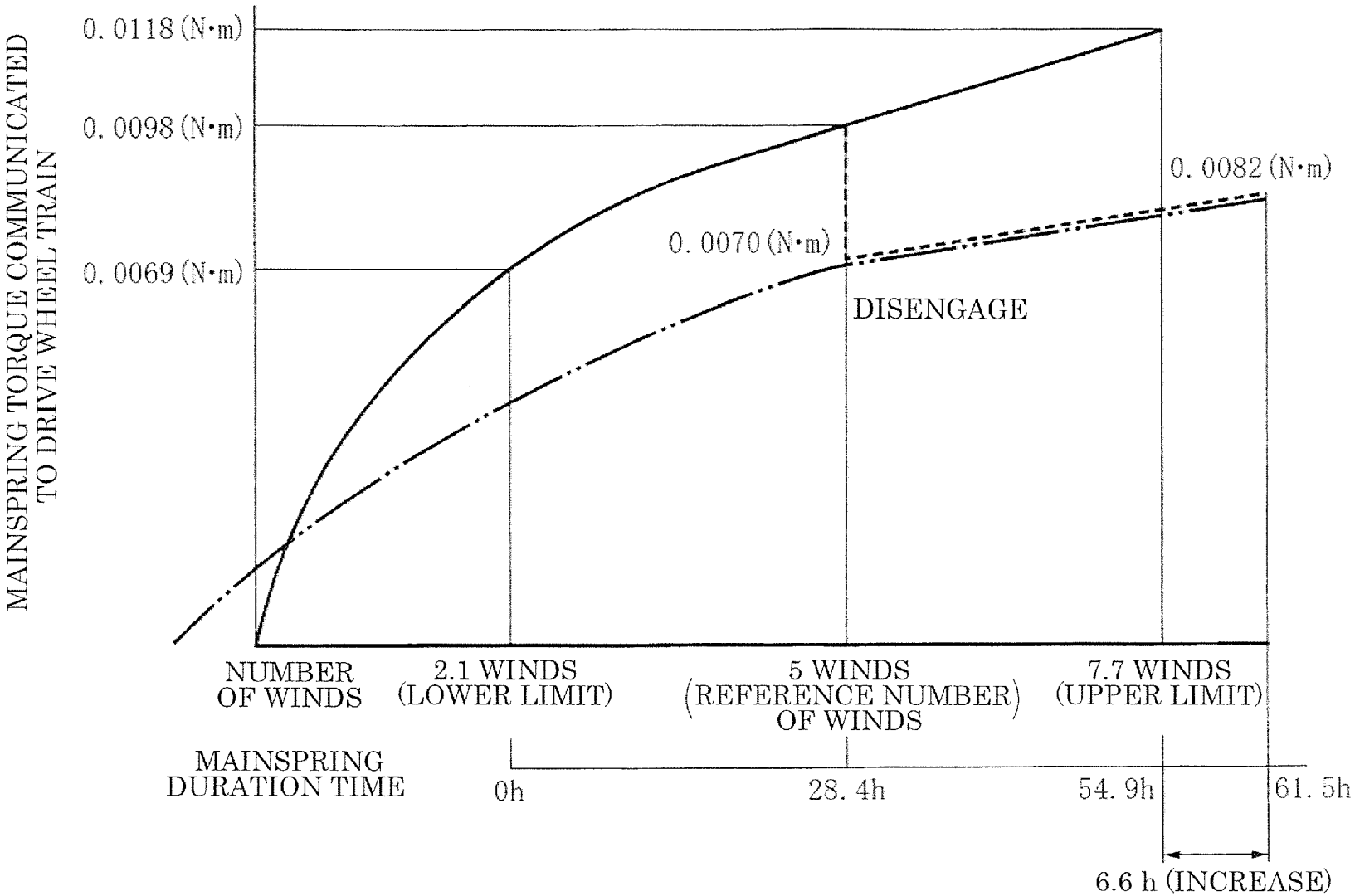
FIG. 24 is a graph showing the relationship between the number of winds in the spring (x-axis) and the torque (y-axis) output from the spring and transmitted to the drive wheel train.

FIG. 24 is a graph showing the relationship between the number of winds in the mainspring 1A (x-axis) and the torque (y-axis) output from the mainspring 1A and transferred to the drive wheel train (the second wheel 2 to the rotor 7).

The torque required to power the drive wheel train is approximately 0.0069 N-m considering age deterioration and shock, and the usable winding range of the mainspring 1A in this embodiment of the invention is set from a lower limit of 2.1 winds corresponding to this torque output of approximately 0.0069 N-m to a maximum limit of 7.7 winds, which is before the mainspring 1A is wound to the end.

The solid curve from a torque of approximately 0.0118 N-m to 0 in FIG. 24 shows the relationship between the number of winds and torque when the mainspring 1A unwinds from the maximum limit of 7.7 winds to drive the drive wheel train until the mainspring 1A is completely unwound without the torque return unit 90 functioning. The duration time of the mainspring 1A is determined by multiplying the number of winds time by the speed-increasing ratio (9.8) of the barrel wheel 1B and second wheel 2, and as shown by the following equation, the duration time when the torque return unit 90 does not function is 54.9 hours.

$$(\text{maximum number of winds } (7.7) - \text{minimum number of winds } (2.1)) * 9.8 = 54.9 \text{ hours}$$

When the torque return unit 90 functions while the number of winds in the mainspring 1A is greater than the reference number of 5 winds as in this embodiment of the invention, the ratchet wheel 11 is wound 0.2 wind for each revolution of the barrel wheel 1B, and the duration time is therefore increased 1.25 times while the torque return unit 90 is functioning. The torque curve while the torque return function is active is indicated by the dotted line in FIG. 24. Note that the time that the torque return unit 90 does not function due to the backlash BK in the first torque return transfer wheel 96 is not considered in FIG. 24.

The torque transferred to the drive wheel train while the torque return function is active is obtained by the following equation.

mainspring output torque−(mainspring output torque/speed-reducing ratio*efficiency)=torque transferred to drive wheel train while torque return function is active Note that in this embodiment of the invention the speed-reducing ratio is 5 and efficiency is 70%.

The duration time before the torque transfer clutch lever 59 disengages (7.7 winds−5 winds) and the duration time after the torque transfer clutch lever 59 disengages (5 winds−2.1 winds) are therefore as follow.

before disengagement: 2.7 winds*1.25*9.8=33.1 hours after disengagement: 2.9 winds*9.8=28.4 hours Adding these total times shows that the maximum duration time of the mainspring 1A in this embodiment of the invention is 61.5 hours, which is a 6.6 hour increase from the duration time of 54.9 hours when the torque return mechanism does not function.

The double-dot dash line in FIG. 24 is the torque curve assuming the torque return unit 90 operates continuously from a full wind of 7.7 winds until the mainspring fully unwinds. In order to operate with at least the approximately 0.0069 N-m of torque required to drive the drive wheel train in this case, a stronger mainspring must be used or the number of winds in the mainspring must be increased to increase the maximum output torque of the mainspring. This means a larger barrel is required.

In this embodiment of the invention the torque return unit 90 does not work until the mainspring 1A unwinds to where the first shaft 961 and second shaft 962 engage because of the backlash BK in the first torque return transfer wheel 96, and the 6.6 hour increase in the duration time of the mainspring enabled by the torque return unit 90 is therefore shortened by 1.2 hours, but the maximum duration time of the mainspring 1A is still increased to 60.3 hours.

Because the maximum duration time of the mainspring is more than 60 hours, a user that normally wears the timepiece during the week but does not wear the timepiece on Saturday and Sunday does not need to wind the crown for the 60 hours from 7:00 p.m. Friday evening to 7:00 a.m. Monday morning. The timepiece is therefore still operating on Monday morning even without winding the crown over the weekend, and the hands therefore do not need to be reset on Monday morning. There is thus a great difference between a mainspring with a maximum duration time of more than 60 hours and a maximum duration time of less than 60 hours.

8. Effects of the Invention

The effects of this embodiment of the invention are described below.

(1) Because a configuration having a torque return unit 90 that returns part of the output torque of the mainspring 1A to the mainspring 1A has a torque transfer clutch lever 59 that is controlled by the sun cam 812 of the sun wheel stem 81, the excess output torque of the mainspring when the number of winds in the mainspring 1A exceeds a reference number of winds (5 winds), that is, when the output torque exceeds the torque required to drive the drive wheel train, is used to wind the mainspring 1A, and when the number of winds is less than the reference number of winds, torque transfer by the torque return unit 90 is disengaged, and torque is not consumed winding the mainspring 1A. As a result, the time from when the mainspring 1A begins unwinding until the drive wheel train and hands stop, that is, the duration time of the mainspring 1A, can be increased.

(2) In addition to increasing the duration time of the mainspring 1A by the amount that the mainspring 1A is wound when the number of winds is greater than the reference number of winds, using this excess torque to wind the mainspring 1A can also suppress communicating the excess torque to the drive wheel train. This improves the durability of the drive wheel train.

In addition, because the excess torque does not work on the drive wheel train, the need for electromagnetic braking of the generator 30 can be reduced and the generator 30 can be made smaller.

(3) The first and second clutch members 53 and 56 of the torque return wheel 50 render a slip mechanism and limit torque transfer in the opposite direction as the speed-reducing direction of the ratchet wheel 11 and barrel wheel 1B. As a result, when the mainspring 1A is wound by the crown, torque from winding the crown is not transferred through the torque return unit 90 to the drive wheel train. Winding the crown therefore does not affect operation of the hands. The number of winds indicated by the sun wheel stem 81 can also be kept correct.

(4) The torque return wheel 50 is rendered by seven parts as described above, and the first and second clutch members 53 and 56 are disengaged by rotation of the torque receiving wheel 51 when the torque transfer clutch lever 59 engages the clutch operating cam 54. Because the ratchet wheel 11 and barrel wheel 1B are thus disengaged in conjunction with rotation of the torque receiving wheel 51, which rotates slowly at substantially the same speed as the barrel 1, the ratchet wheel 11 and barrel wheel 1B can be disengaged with less load on the mainspring 1A.

(5) The duration time of the mainspring 1A can also be improved without increasing the size of the spring device because the parts of the torque return wheel 50 are small and these parts can be configured efficiently.

(6) The sun cam 812 has first to third working parts 812A to 812C, and control of the three functions associated with the torque transfer clutch lever 59, the winding limiting part 42, and the movement limiting part 43 is concentrated on a single sun cam 812. The configuration is therefore relatively simple.

(7) Even if the torque return function works when the winding limiting part 42 is locked, the torque return unit 90 cannot wind the mainspring 1A and the mainspring 1A cannot unwind, and the spring device therefore stops. As a result, the shaft of the first torque return transfer wheel 96 is a two part construction of a first shaft 961 and second shaft 962, and there is backlash BK between the first shaft 961 and second shaft 962. The torque return function therefore does not work until the mainspring 1A unwinds from where the winding limiting part 42 locks to where it is released, and the torque limiter mechanism of the mainspring and the torque return mechanism can therefore both be used effectively.

(8) The speed-reducing ratio between the sun pinion 813 and winding indicia rack 801 before the torque transfer clutch lever 59 disengages is smaller than the speed-reducing ratio after the torque transfer clutch lever 59 disengages by the amount that the mainspring 1A is wound by the torque return unit 90. Movement of the power reserve hand before and after the torque transfer clutch lever 59 disengages is therefore uniform, and the power reserve of the mainspring 1A can therefore be easily determined from the position indicated by the power reserve hand 28.

(9) The speed-reducing ratio of the sun pinion 813 and winding indicia wheel 80 can be easily changed by rendering the winding indicia rack 801 and sun pinion 813 with a plurality of tooth forms (group A and group C) while the backlash that tends to increase with such a configuration can be contained by the spring 802. The power reserve hand 28 can therefore be prevented from bouncing. The power reserve hand 28 can therefore be driven to the correct position even if the power reserve hand 28 moves back and forth between the different tooth forms according to the increase or decrease in the power reserve of the mainspring 1A.

Embodiment 2

Figure 25:
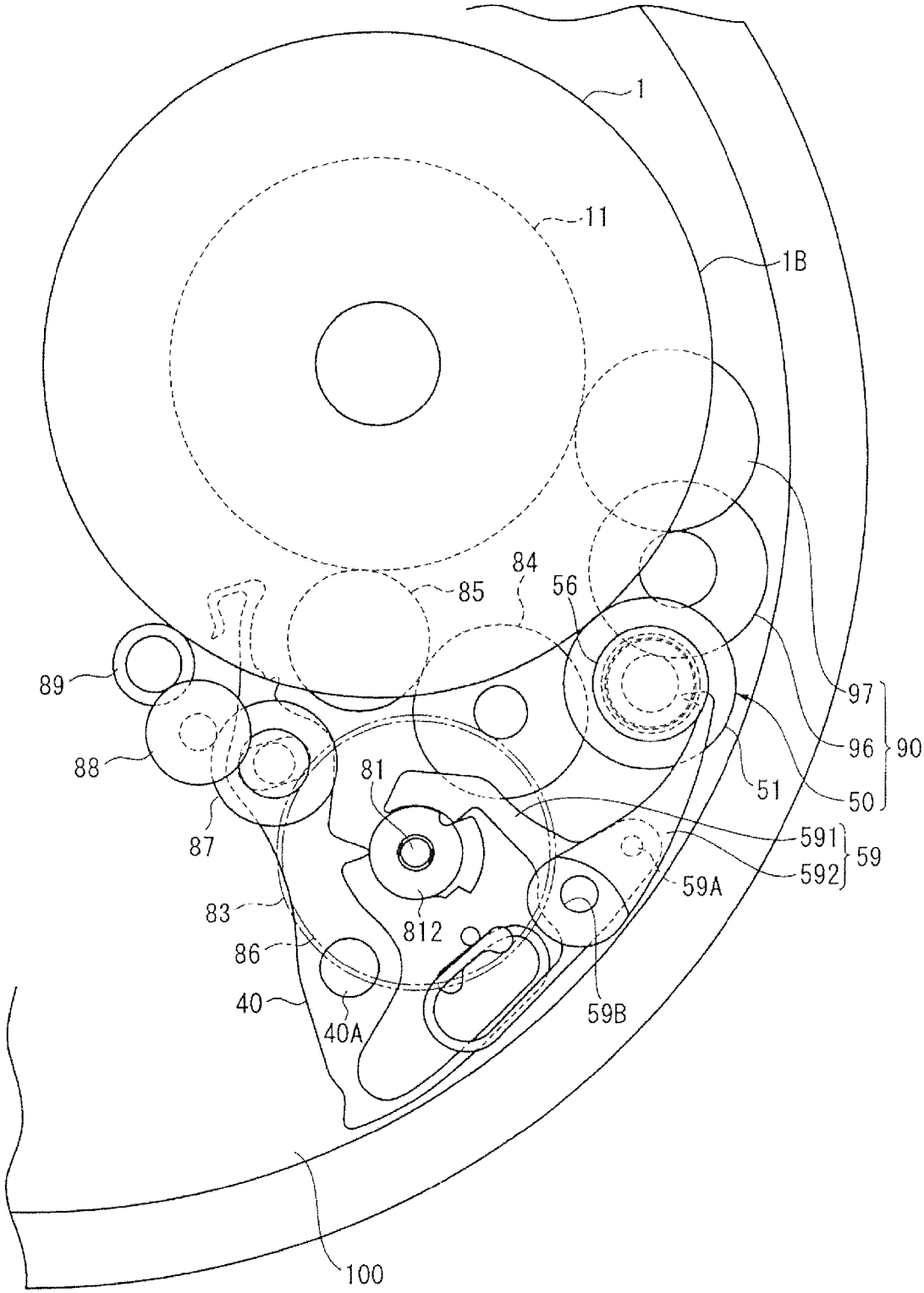
FIG. 25 is a plan view showing the main parts of a mechanical timepiece according to a second embodiment of the invention.

FIG. 25 is a plan view of part of a timepiece according to a second embodiment of the invention. The timepiece according to the first embodiment of the invention is an electronically controlled mechanical timepiece that has a crystal oscillation circuit. The timepiece according to this embodiment of the invention is a mechanical timepiece that mechanically produces the time standard by means of a regulator that operates in conjunction with the drive wheel train.

The movement of the timepiece according to this embodiment of the invention includes a barrel 1, the wheels of a drive wheel train for driving hands not shown, an escapement including an escape wheel and pallet fork, and a regulator with a balance. The mechanical timepiece of this embodiment has the same duration time display mechanism (power reserve mechanism), torque limiter mechanism, movement stopping mechanism, and torque return mechanism described in the first embodiment above.

The duration time indicating unit of the duration time display mechanism is composed of the sun cam 812 described above.

The torque limiter mechanism includes the torque limiter lever 40.

The torque return mechanism includes the torque return unit 90 connecting the barrel wheel 1B and ratchet wheel 11, and the torque transfer clutch lever 59 for engaging and disengaging the connection to the barrel wheel 1B and ratchet wheel 11.

As in the first embodiment, the torque transfer clutch lever 59 operates according to the position of the sun cam 812 in this embodiment of the invention, and the torque return wheel 50 therefore engages and disengages the connection between the barrel wheel 1B and ratchet wheel 11. The duration time of the mainspring 1A can therefore be increased without such measure that increase the volume of the mainspring 1A. The configuration of this embodiment of the invention also achieves the same effects as the first embodiment described above.

Embodiment 3

Figure 26:
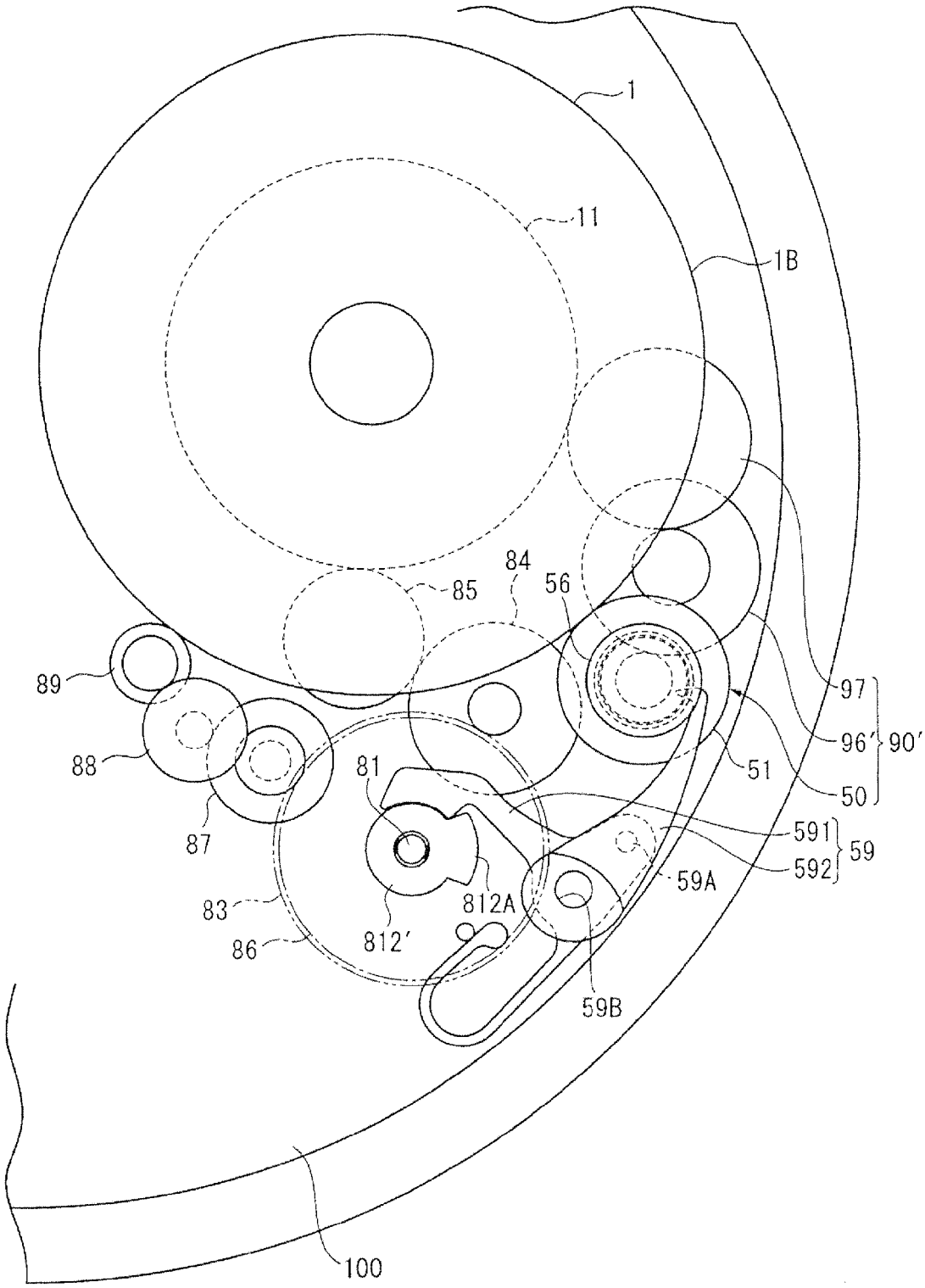
FIG. 26 is a plan view showing the main parts of a mechanical timepiece according to a third embodiment of the invention.

FIG. 26 is a partial plan view of a mechanical timepiece according to a third embodiment of the invention. This embodiment does not have the torque limiter mechanism and movement stopping mechanism described above. The configuration of the mechanical timepiece according to this embodiment of the invention is otherwise the same as the configuration of the mechanical timepiece according to the second embodiment described above.

This embodiment of the invention does not have the torque limiter lever 40 (FIG. 2), the second working part 812B and the third working part 812C of the sun cam 812' associated with the torque limiter mechanism and movement stopping mechanism. The shaft of the first torque return transfer wheel 96' is also different from the first embodiment, and is rendered using a single part.

Because the electronically controlled mechanical timepiece described above requires a high precision movement, the rotor may turn too quickly if the mainspring is overwound by the crown, and the movement may not be accurate if the output torque of the mainspring drops below the torque range where braking by the electromagnetic brake is necessary, the torque limiter mechanism and movement stopping mechanism are needed to keep the number of winds in the mainspring within a specific range. In a mechanical timepiece, however, the period of the escapement does not deviate greatly and the loss of precision is not great even if the mainspring 1A is overwound by the crown so that the balance rebounds at the end of its stroke. The need for the torque limiter mechanism and movement stopping mechanism is therefore less in a mechanical timepiece than in an electronically controlled mechanical timepiece.

However, in order to prevent a drop in the durability of the mainspring 1A caused by overwinding the mainspring 1A, the mechanical timepiece preferably also has the torque limiter mechanism as in the second embodiment of the invention.

This embodiment of the invention achieves the same effects as the first and second embodiments of the invention because the torque return unit 90' and torque transfer clutch lever 59 function according to the rotational position of the sun cam 812' as in the first and second embodiments. Because there is no backlash on the shaft of the first torque return transfer wheel 96' in this embodiment, the torque return unit 90' functions from when the mainspring 1A starts unwinding. The duration time of the mainspring 1A is therefore not shortened by the backlash of the first torque return transfer wheel 96 as in the first embodiment, and the duration time of the mainspring 1A can be increased even more. The high torque output when the mainspring begins unwinding is also consumed winding the mainspring and does not act on the drive wheel train, and the durability of the wheel train and bearings can be improved.

Other Embodiments of the Invention

The spring device of the invention is not limited to use in timepieces as described above, and can also be used in music boxes, toys, and other devices that are driven by a spring. In a music box the inside end of the mainspring is typically fastened to the shaft of the inside-end wheel, and the same effects as the embodiments described above can be achieved by rendering a torque return unit connecting the shaft linked to the inside end of the mainspring and the outside-end wheel linked to the outside end of the mainspring, and a torque transfer clutch unit that can engage and disengage the linkage between the inside-end wheel and the outside-end wheel by means of the torque return unit.

The reference number of winds at which the torque transfer clutch unit disengages is set desirably according to the maximum output torque of the spring, the torque required to drive the drive wheel train, and the speed-reducing ratio between the inside-end wheel and outside-end wheel of the torque return unit.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

What is claimed is:

1. A spring device comprising:

an inside-end wheel that moves in conjunction with the inside end of a mainspring;

an outside-end wheel that moves in conjunction with the outside end of the mainspring;

a torque return unit that transfers part of the output torque of the mainspring from one to the other of the inside-end wheel and outside-end wheel;

a duration time indicating unit that operates in conjunction with both the inside-end wheel and outside-end wheel and indicates the number of winds in the mainspring; and a torque transfer clutch unit that disengages torque transfer between the inside-end wheel and outside-end wheel by means of the torque return unit when the mainspring unwinds and the duration time indicating unit indicates a predetermined reference number of winds.

2. The spring device described in claim 1, wherein:

the torque return unit restricts torque transfer in the opposite direction as the torque transfer direction between the inside-end wheel and outside-end wheel.

3. The spring device described in claim 1, wherein:

the torque return unit includes a torque receiving wheel that receives torque from the mainspring, a torque return wheel that is disposed coaxially to the torque receiving wheel and returns torque from the mainspring toward the mainspring, a pair of clutch members that are disposed coaxially to the torque receiving wheel and the torque return wheel respectively and engage by relative movement therebetween in the axial direction, a clutch operating cam that is disposed coaxially to one of the clutch members and has a spiral step that rises toward the other clutch member, and an urging member that urges the one clutch member to the other clutch member and causes the clutch members to engage;

the torque transfer clutch unit includes a clutch lever that engages the clutch operating cam;

the clutch lever engages the clutch operating cam when the mainspring unwinds and the duration time indicating unit indicates the reference number of winds; and engagement of the pair of clutch members is disengaged when the torque receiving wheel rotates after the clutch lever engages the clutch operating cam.

4. The spring device described in claim 1, wherein:

a winding unit that operates when the mainspring is wound by a winding member, and an unwinding member that operates when the mainspring unwinds, are disposed to the duration time indicating unit; and the duration time indicating unit includes a first working part that operates a lever rendering the torque transfer clutch unit, a second working part that operates a torque limiter member that locks the winding unit when the mainspring is wound to a maximum number of winds, and a third working part that operates a drive limiting member that locks the unwinding unit when the mainspring unwinds to a minimum number of winds.

5. The spring device described in claim 1, wherein:

a winding unit that operates when the mainspring is wound by a winding member, and torque limiter member that locks the winding unit when the mainspring is wound to a maximum number of winds, are disposed to the duration time indicating unit;

the torque return unit includes a connecting shaft composed of a first shaft and a second shaft that are connected coaxially, a first shaft receiving wheel that moves in conjunction with the first shaft and receives torque from the mainspring, a second shaft return wheel that moves in conjunction with the second shaft and returns torque from the mainspring to the mainspring, and the first shaft has a predetermined amount of backlash enabling rotation relative to the second shaft from when the mainspring begins to unwind until locking by the torque limiter member is disengaged.

6. The spring device described in claim 1, further comprising:

a duration time display wheel that speed reduces rotation of the duration time indicating unit; and an indicating member attached to the duration time display wheel;

wherein the speed-reducing ratio of the duration time indicating unit and the duration time display wheel when torque transfer between the inside-end wheel and outside-end wheel is engaged by the torque transfer clutch unit is smaller than the speed-reducing ratio of the duration time indicating unit and duration time display wheel when torque transfer is disengaged by the torque transfer clutch unit.

7. The spring device described in claim 6, wherein:

the duration time display wheel and the duration time indicating unit each have tooth forms of a first speed-reducing ratio that mesh when the torque transfer clutch unit is engaged, and tooth forms of a second speed-reducing ratio that mesh when the torque transfer clutch unit is disengaged; and an urging member that constrains backlash between the duration time indicating unit and the duration time display wheel is disposed to the duration time display wheel.

8. A timepiece that comprises the spring device described in claim 1; and operates using the mainspring as the power source.

* * * * *